US009088094B2

(12) United States Patent
Iyer et al.

(10) Patent No.: US 9,088,094 B2
(45) Date of Patent: Jul. 21, 2015

(54) ELECTRICAL CONNECTOR HAVING A PLUG AND A SOCKET WITH ELECTRICAL CONNECTION BEING MADE WHILE SUBMERGED IN AN INERT FLUID

(71) Applicant: BAE Systems Land & Armaments, L.P., Santa Clara, CA (US)

(72) Inventors: Hari Iyer, Mercerville, NJ (US); Robert Michael Barlow, Rochester Hills, MI (US); Patrick J. Dolan, Rochester Hills, MI (US)

(73) Assignee: BAE Systems Land & Armaments L.P., Santa Clara, CA (US)

( * ) Notice: Subject to any disclaimer, the term of this patent is extended or adjusted under 35 U.S.C. 154(b) by 84 days.

(21) Appl. No.: 13/839,520

(22) Filed: Mar. 15, 2013

(65) Prior Publication Data

US 2014/0273571 A1 Sep. 18, 2014

(51) Int. Cl.
*H01R 13/53* (2006.01)
*H01R 13/453* (2006.01)

(52) U.S. Cl.
CPC ..... *H01R 13/53* (2013.01); *H01R 13/4538* (2013.01); *Y10T 29/49117* (2015.01)

(58) Field of Classification Search
USPC ..... 439/140, 183, 186, 187
See application file for complete search history.

(56) References Cited

U.S. PATENT DOCUMENTS

| | | | | |
|---|---|---|---|---|
| 3,932,195 | A | 1/1976 | Evans et al. | |
| 4,113,339 | A * | 9/1978 | Eley | 439/183 |
| 4,227,765 | A | 10/1980 | Neumann et al. | |
| 4,553,000 | A | 11/1985 | Appleton | |
| 4,589,959 | A | 5/1986 | Nakamatsu et al. | |
| 4,703,986 | A | 11/1987 | McCormick | |
| 5,114,357 | A * | 5/1992 | Luzzi | 439/183 |
| 5,484,296 | A * | 1/1996 | Taylor | 439/140 |
| 6,145,894 | A | 11/2000 | Myers | |
| 6,431,888 | B1 | 8/2002 | Crestin | |
| 7,097,515 | B2 | 8/2006 | Siddiqi et al. | |
| 8,272,790 | B2 * | 9/2012 | Belsan et al. | 385/75 |
| 8,808,017 | B2 * | 8/2014 | York et al. | 439/183 |
| 2002/0164896 | A1 * | 11/2002 | Borgstrom et al. | 439/183 |
| 2003/0063867 | A1 * | 4/2003 | McDonald et al. | 385/78 |
| 2011/0123157 | A1 | 5/2011 | Belsan et al. | |

FOREIGN PATENT DOCUMENTS

KR 100850925 8/2008

OTHER PUBLICATIONS

International Search Report and Written Opinion from related PCT Application PCT/US2014/023633, dated Aug. 12, 2014, 5 pgs.

* cited by examiner

*Primary Examiner* — Chandrika Prasad
(74) *Attorney, Agent, or Firm* — Patterson Thuente Pedersen, P.A.

(57) ABSTRACT

A high-voltage power connector comprising mating plug and socket assemblies. The socket assembly can include a hollow core surrounded by a bellows assembly filled with an inert liquid that eliminates arcing when an electrical connection is formed or broken. Embodiments of the plug and socket assemblies can include multiple contacts that first couple in air before an electrical circuit is formed and as the plug and socket are mated additional contacts inside the socket assembly mate while surrounded by an inert arc-suppressing fluid.

4 Claims, 27 Drawing Sheets

ELECTRICAL CONNECTOR HAVING A PLUG AND A SOCKET WITH ELECTRICAL CONNECTION BEING MADE WHILE SUBMERGED IN AN INERT FLUID

FIELD OF THE INVENTION

The present invention is directed to releasable connectors, and more specifically to high-voltage or high-current connectors that eliminate arcing when a connection is formed or broken.

BACKGROUND OF THE INVENTION

In various situations the selective delivery of high-voltage direct current (DC) is required between a voltage source and various electrical components. Presently, existing high-voltage connectors require very high insertion/extraction forces, making it difficult to mate or unmate a plug with its corresponding socket.

High contact resistance is also encountered with existing connectors, along with a corresponding high voltage drop in the power distribution system. Thermal dissipation due to the resistance raises the contact temperature and results in deterioration of the electrical contacts and reduces the life span of the connector. High-voltage arcs that are often formed during mating and unmating of high-voltage connectors further pit or degrade electrical contact surfaces.

High transient startup currents and non-rounded edges incorporated into contact interfaces can further increase the possibility of undesirable arc formation. Due to the risk of corona and arcing some existing high-voltage connectors cannot be mated while an electric current is present (hot plugged). Ground fault sensing circuits and arc fault circuits have been used for leakage detection and to provide a level of safety, however these approaches are prone to failure. Known electronic arc suppression circuits often take up space that is at a premium and add undesirable weight and cost to high-voltage distribution systems.

High altitude conditions can also increase the possibility of arcing and limit the operational capabilities of known connectors. In tactical conditions; problems such as radio communication or navigation disruption caused by electromagnetic interference (EMI) are often encountered due to arcing.

Various connector designs have attempted to address these and other connector issues in a variety of environments. Examples include U.S. Pat. Nos. 7,097,515, 6,431,888, 4,703,986, 4,598,959, 4,553,000, and 4,227,765, each of which is herein incorporated by reference in its entirety.

SUMMARY OF THE INVENTION

Embodiments of the present invention are directed toward a high-voltage (HV) power connector comprising a mating plug and socket assemblies. The socket assembly can include a hollow core surrounded by a bellows assembly filled with an inert liquid that eliminates arcing when an electrical connection is formed or broken. The socket assembly face includes a low insertion force socket to receive a HV plug assembly. As the plug and socket assembly faces are coupled the plug and socket contacts mate, the bellows inside the socket are then compressed, coupling the electrical conductors in the socket assembly face to a low resistance socket contact inside the bellows assembly. The structure of the plug and socket assemblies assures that the mating or breaking of the HV electrical circuit occurs at the interface of the electrical conductors inside the fluid filled bellows, thus eliminating the possibility of arcing.

One example of a need for such a connector is encountered in tactical military vehicles, where a HV power distribution system distributes DC power between various components in the chassis, turret and propulsion systems. Other examples where the use of a high-voltage DC power coupler would be advantageous include electric or hybrid-electric vehicles, computer data centers, MRI or other HV medical equipment, down hole drilling tools and radar systems.

In one embodiment, a HV connector plug assembly includes one or more recessed electrical connectors or contacts housed in a spring-loaded insulator that forms the face of the plug assembly when disconnected. The spring-loaded insulator recedes into the plug assembly, exposing the plug's electrical connectors when the plug is mated to an appropriate socket. As the plug and socket assemblies are mated together the electrical connectors housed within the respective faces of the socket and the plug mate, before an electrical connection is established. As the plug and socket are seated together, an electrical connection is established between connectors that are internal to and enclosed by an assembly within the socket assembly.

In one embodiment, a HV connector assembly reduces the amount of space used for connectors and arc suppression equipment. A HV connector assembly can also provide low insertion/extraction coupling force requirements and low contact resistance by utilizing contact types such as the HYPERTAC® style contacts (Hypertac Ltd. is part of Smith Interconnect) or the RADSOK® contacts (available from the Amphenol Corporation). Additionally, other types of contacts that were initially intended for low-voltage levels can be updated for voltages as high as several kilo-volts by providing insulation-materials, rounding edges, and increasing the creep path of the mated contact insulation The electrical contact improvements disclosed herein can drastically lower the mated contact's temperatures and increase the useful life of the connector.

In one embodiment, a HV connector includes a hydraulic quick-disconnect coupler that includes electrical insulation. Various quick-disconnects are available from a variety of manufacturers for different applications (e.g. Adel Wiggins for aircraft, Parker for industrial, etc.). Similar fluid power-couplings with modified electrical insulation and a captive inert fluid are included in the high-voltage connector. The captive fluid can be FC-72 (available from 3M) or an equivalent that suppresses high-voltage arcing. In one embodiment, the connector contacts will be immersed in the inert fluid when connecting to a load.

In another embodiment a high voltage connector system uses an intermediate adapter with one end connected to the power source (socket end) and the opposite end with load (plug end). The adapter can be powered on or off without the need to disconnect or connect the load plug.

In one embodiment, a HV connector includes electrical contacts that comprise heat pipes. Heat pipes can be constructed from copper cylinders and have a thermal conductivity that are about 30 to 100 times that of solid copper. The heat pipe concept reduces the formation of hot spots on the contacts, reduces the contact temperature by transferring heat from the contact to the bulk conductor or wire cable attached to the connector. In various embodiments the contact can comprise a copper, copper-tungsten, beryllium-copper, or gold-plated copper alloy. The heat pipe contacts can be lower in weight than a solid copper contact of a similar size.

In another embodiment pyrolytic graphite material for example Kcore, a Thermacore Inc. product, or pyrolytic graphite sheet (PGS), available from Panasonic Corp., that is electrically conductive, is encapsulated into the copper contact. The density of Kcore or Pyrolytic graphite is much lower than copper (about one third) and the directional thermal conductivity more than twice of copper. This results in thermally superior contact with lower contact weight.

BRIEF DESCRIPTION OF THE DRAWINGS

The invention may be more completely understood in consideration of the following detailed description of various embodiments of the invention in connection with the accompanying drawings, in which.

Figure 1:
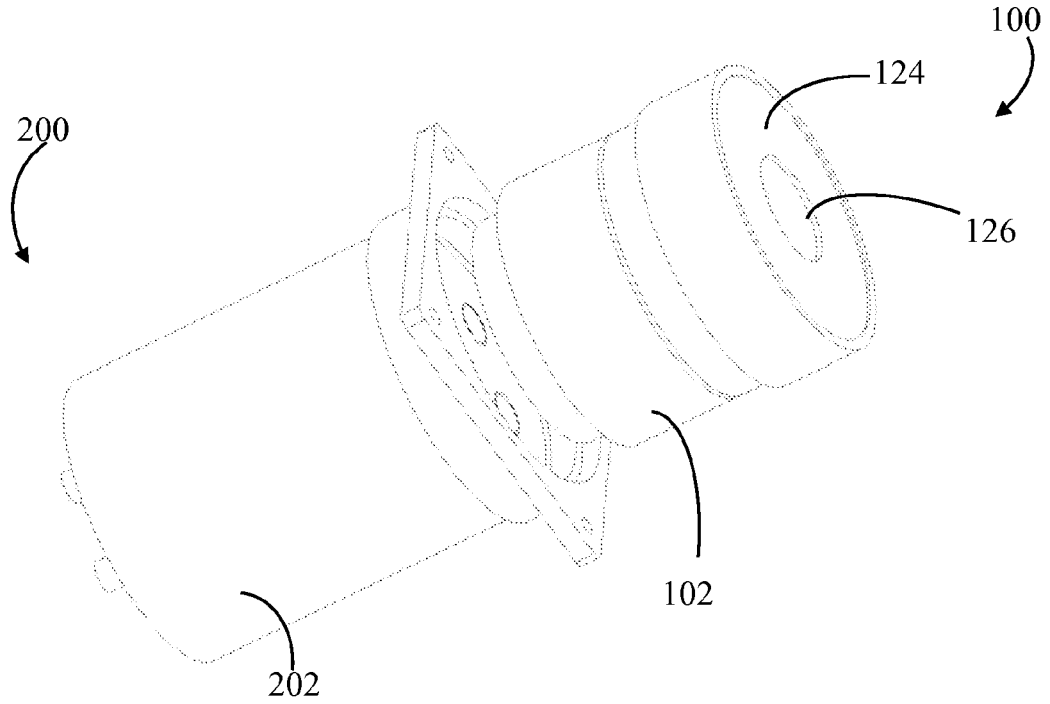
FIG. 1 is a perspective view of a socket and plug connector system according to an embodiment of the invention.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives.

DETAILED DESCRIPTION OF THE DRAWINGS

While this invention may be embodied in many different forms, specific preferred embodiments of the invention are described in detail herein. These descriptions exemplify the principles of the invention and are not intended to limit the invention to the particular embodiments illustrated.

Turning now to the drawings, FIG. 1 depicts an exemplary embodiment of a multi-pin connector system including a plug assembly 100 and a socket assembly 200. The plug assembly 100 and a socket assembly 200 are depicted just prior to initial contact, and without their respective electrical cables, for clarity. Plug assembly 100 includes outer plug housing 102 and rear insulator 124. The plug assembly 100 can include a rear insulator 124 that forms opening 126 to provide a passageway from the electrical wire or cable. Socket assembly 200 includes an outer socket housing 202.

Figure 2:
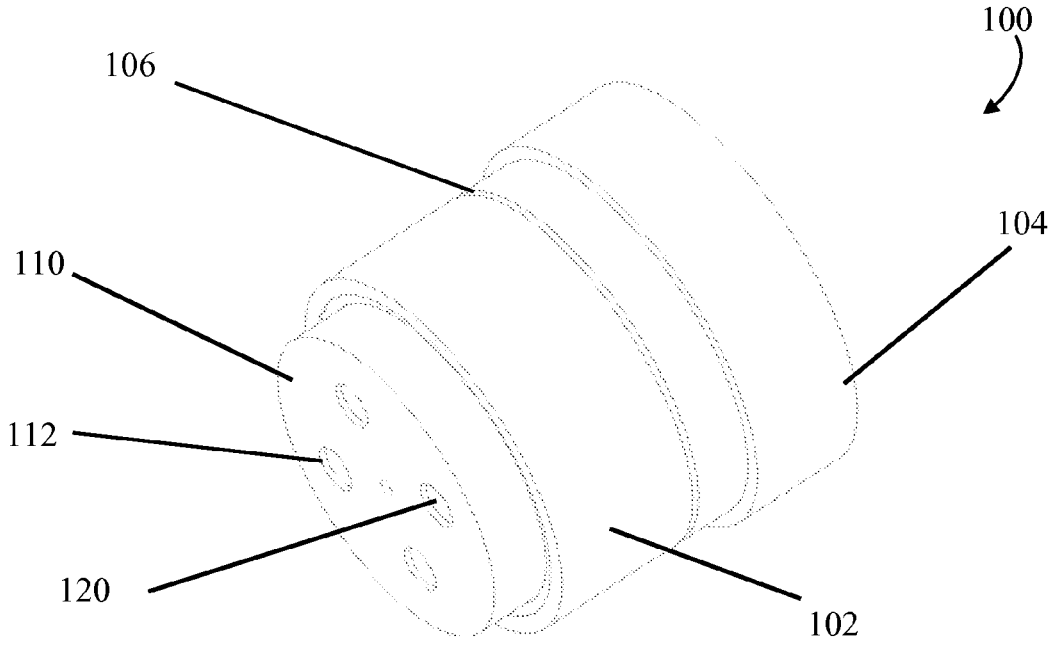
FIG. 2 is a perspective view of a connector plug assembly according to an embodiment of the invention.

FIG. 2 depicts a plug assembly 100 that includes an outer plug housing 102, a back cover 104 and a locking detent 106. Plug assembly 100 also includes a plug insulator 110 positioned within the outer plug housing 102. The plug insulator 110 defines one or more openings 112 for four electrical plug posts 120. In one exemplary embodiment, the four electrical contacts can correspond to circuits providing +/−300 VDC, power-ground and system-ground. The housing 102 and cover 104 can be constructed from any of a variety of materials, including, for example, metal or plastic.

Figure 3:
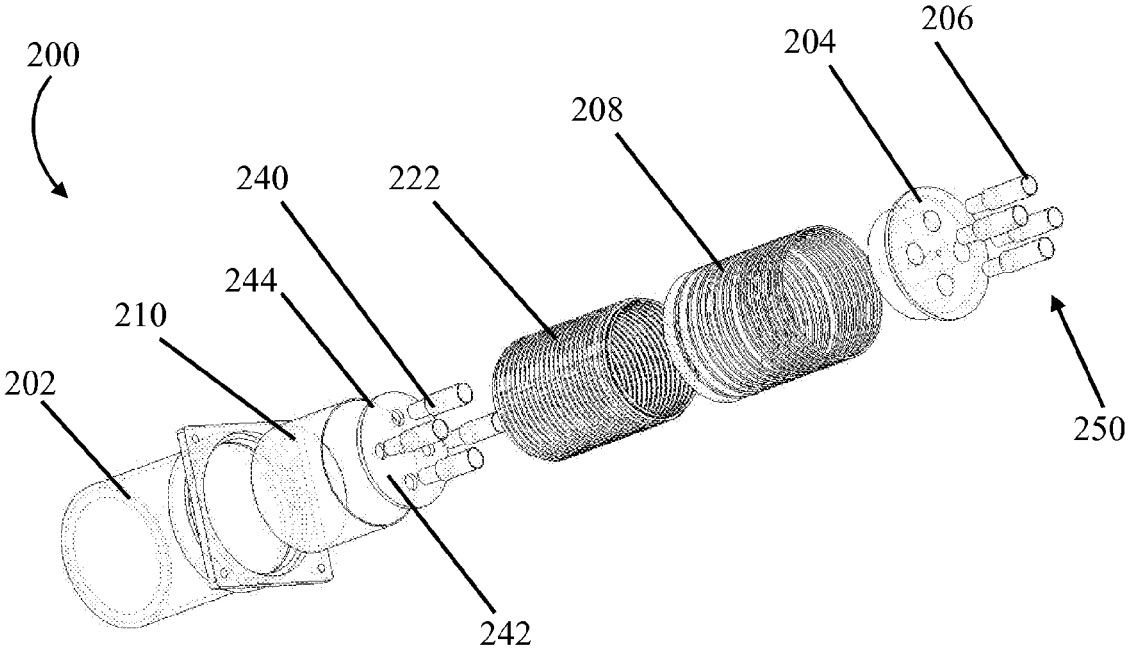
FIG. 3 is an exploded view of a connector socket assembly according to an embodiment of the invention.

FIGS. 3-7 depict a socket assembly 200 that includes an outer socket housing 202, a socket insulator 204 and four electrical socket interfaces 206 configured to mate with the electrical plug posts 120 of the plug assembly 100. The outer socket housing 202 also includes a plurality of balls 290 around indent 292 to releasably mate with the locking detent 106 of plug 100. An exterior machined compression spring 208 of varying loop sections surrounds an underlying bellows assembly 220, depicted in FIG. 4. Machined compression spring 208 is biased to expand the bellows in the outward direction. Examples of machined compression springs are available from Helical Products Company, Inc. of Santa Maria, Calif. During compression, the spring 208 is generally soft in the beginning (easily deformed top loops) and generally becomes harder to push (more rigid bottom loops) after the initial compression. FIG. 3 also depicts a socket insulator 210, such as polyether ether ketone (PEEK), or other appropriate insulator, that also keeps the bellows assembly 220 and spring 208 from binding when the spring 208 is compressed. Socket insulator 210 is sized to maintain a small gap around bellow 222 to avoid excessive bulging of bellow 222 when compressed. In an alternate embodiment the socket insulator is not necessary; the machined spring can be positioned around the bellows with a gap while the interior of the socket housing 202 can be coated with an appropriate ceramic to insulate the socket assembly 200.

Figure 4:
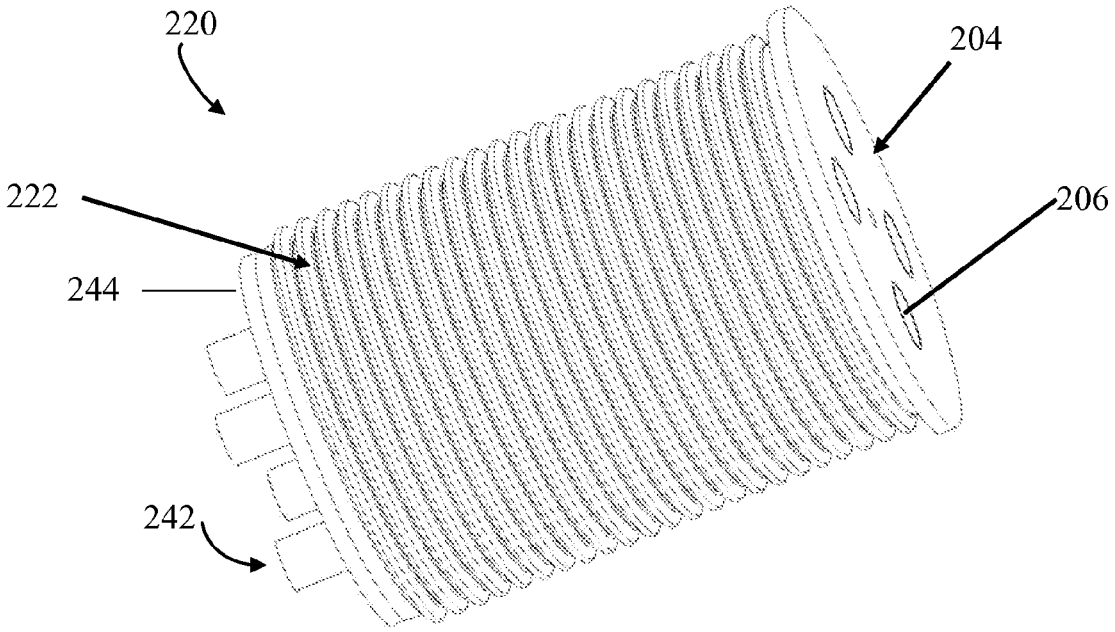
FIG. 4 is a perspective view of a connector-socket bellows assembly according to an embodiment of the invention.

FIG. 4 depicts a bellows assembly 220 of the socket assembly 200 that includes a bellow 222 that is sealed at one end to the socket insulator 204 and on the other end by insulator 244. In one example embodiment, the socket insulators 204 and 244 can be a ceramic material and the bellow 222 can be a metal material. Other appropriate materials (e.g. various plastics) can be substituted depending on the specific needs of individual applications. The socket insulators 204 and 244 and the bellow 222 can be joined by (ceramic to metal) brazing or another appropriate joining method depending on the materials used to construct the individual components. The bellow 222 is not in electrical contact with socket interfaces 206 or plug interface 242.

Figure 5:
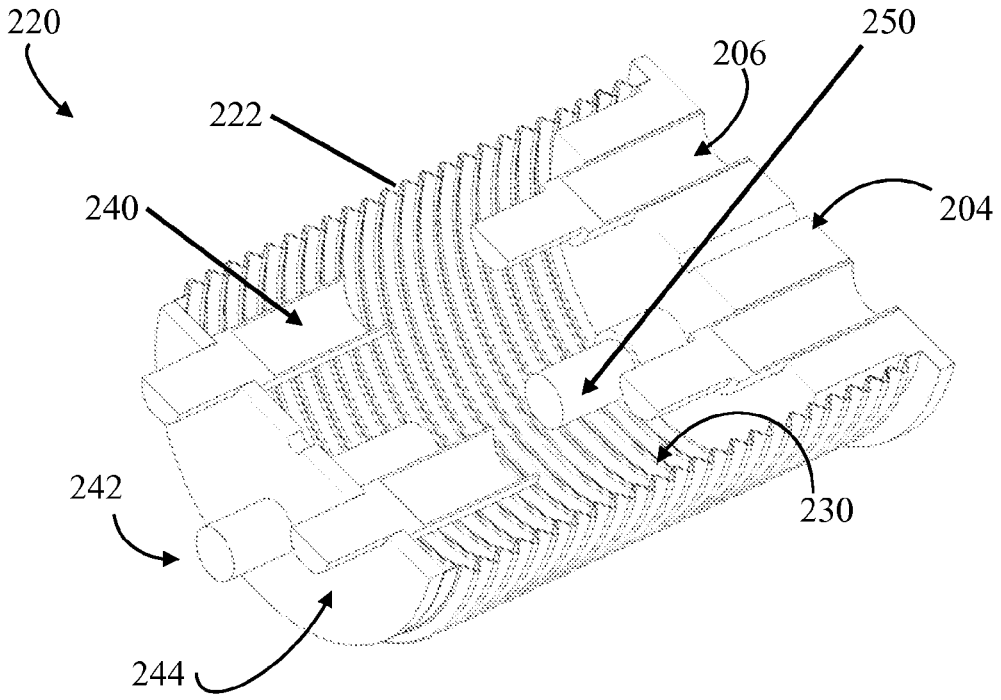
FIG. 5 is a cutaway perspective view of the connector socket bellows assembly of FIG. 4.

As depicted in FIG. 5, the bellows forms an interior bellows container 230 that can be filled with inert electronic liquid such as Fluorinert (trademark 3M Co.), perfluorohexane (FC-72), or a similar equivalent fluid depending on the expected operating temperature requirements of the connector assembly. Various fluids, such as FC-72, FC-77, FC-84, FC-87, and other similar fluids, can be mixed together in varying proportions to provide a suitable fluid based on the desired boiling point or high voltage capacity characteristics necessary to accommodate specific operating conditions. The bellows assembly 220 defines a space for the expansion and contraction of the inert liquid within interior container 230. The interior container is generally filled with a quantity of fluid sufficient to immerse the female contacts 240 and male contacts 250 in a fluid regardless of the orientation of the socket assembly 200. In one embodiment the interior container 230 is not completely filled with fluid in order to provide sufficient space for expansion of the fluid due, for example, to an increase in operating or ambient temperature.

The sealed bellows assembly also can function as a guide mechanism to ensure that the electrical contacts disposed at opposite end of the bellows assembly are properly aligned when the two ends are forced together inside a housing. Additional environmental seals, o-rings, or other synthetic rubber or fluoropolymer elastomer seals are not shown but can be included in both the socket assembly 200 and the plug assembly 100 to prevent the introduction of external elements into the assembly or the escape of the inert fluid in the case of an accident. Examples of environmental seals include fluoroelastomer seals. One example of an environmental seal is the VITON® product available from DuPont Performance Elastomers LLC of Wilmington, Del., an affiliate of the DuPont Company.

Figure 6:
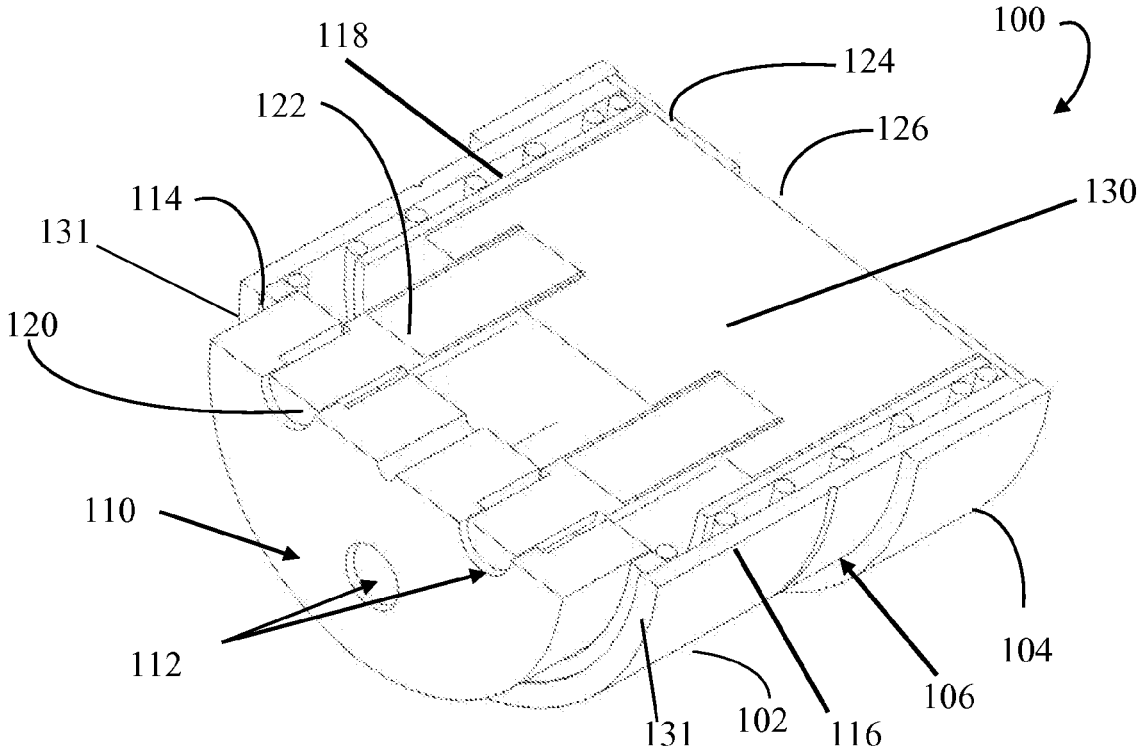
FIG. 6 is a cutaway perspective view of a connector plug assembly according to an embodiment of the invention.

FIG. 6 depicts a plug assembly 100 that includes plug insulator 110 disposed on a push ring 114 that centers the plug insulator 110 in the open face of the plug assembly 100. The push ring 114 attached to insulator 110 is coupled to a plug spring 116 that travels along in the interior surface of the plug housing 102. Plug spring 116 provides tension that directs the plug insulator 110 towards the retaining lip 131 at the open end of the plug housing 102. The physical interference of the push ring 114 and the retaining lip 131 retain the plug insulator 110 in the plug assembly 100. An insulating sheath 118 separates the plug spring 116 and the plug housing 102 from the interior cavity of the plug assembly 100. The size of insulating sheath 118 can also define the limit of the distance that plug insulator 110 can move into the plug assembly 100.

An electrical plug post 120 is disposed in each of the openings 112 and coupled with the plug insulator 110. As with the socket assembly 200, the plug insulator can be a ceramic or other non-conductive material. Plug post 120 can be formed from any of a variety of electrical conductors, including copper, tungsten-copper or a gold-plated beryllium-copper alloy. Plug post 120 can include a wire opening 122 that provides a connection point for an electrical cable or wire to be soldered, welded, or otherwise attached to plug post 120. Wire opening 122 that is part of 120 is held fixed in place by high voltage potting 130. Insulator 110 with ring 114 can slide over 120. The plug assembly 100 can include a rear insulator 124 that forms opening 126 to provide a passageway from the electrical wire or cable that is attached to plug post 120. Once the connection to plug post 120 is complete, opening 126 can be filled with an appropriate insulating material to seal the plug assembly 100.

Pressure can be applied to plug insulator 110 sufficient to overcome the force of plug spring 116 and move plug insulator 110 into the plug assembly 100. As the plug insulator 110 recedes into the plug assembly 100, the electrical plug post(s) 120 are exposed, allowing an electrical connection to be made to socket interfaces 206 of an appropriately configured socket assembly 200. In one embodiment the amount of force required to overcome plug spring 116 is less than that required to compress spring 208 of the socket assembly 200. This configuration allows the electrical connection between electrical plug post 120 and socket interfaces 206 to be established before a complete electrical circuit is made by fully matting the plug assembly 100 with the socket assembly 200.

Figure 7:
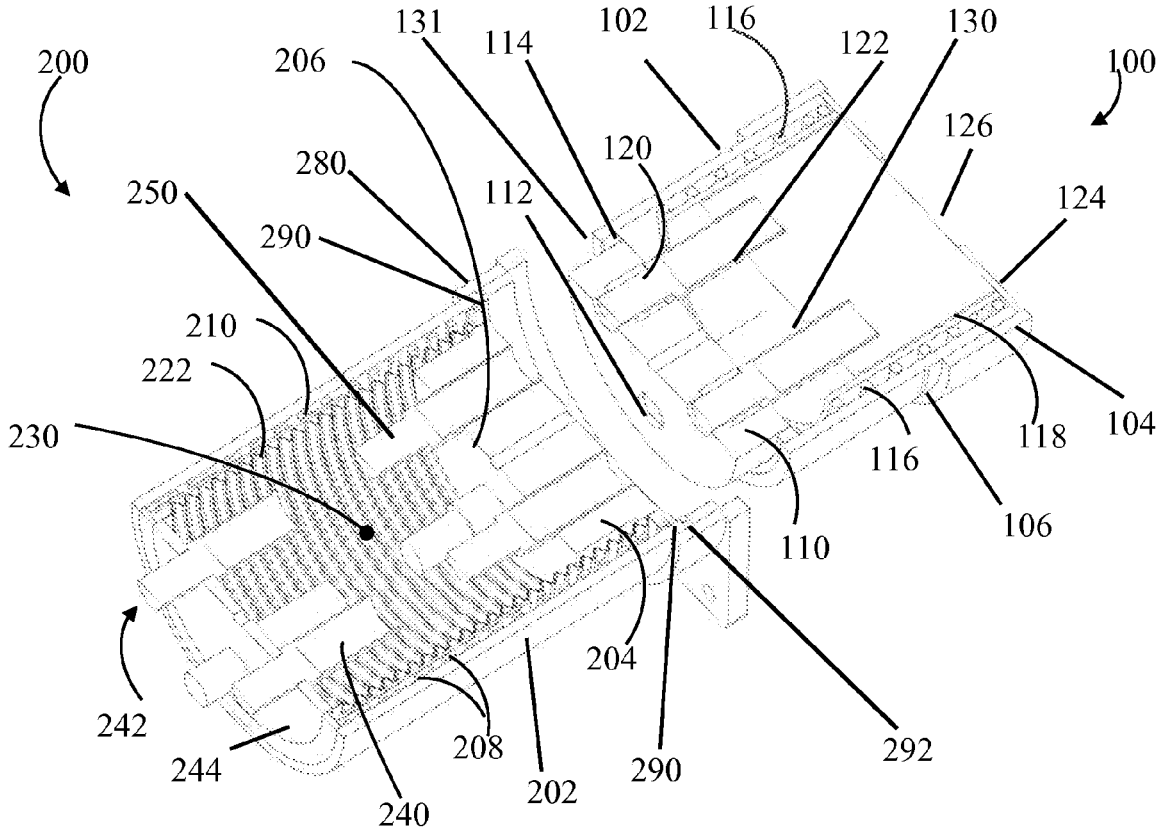
FIG. 7 is a cutaway perspective view of a set of HV connector socket and plug assemblies unmated.

As depicted in FIG. 7 an embodiment of plug post 120 can comprise two generally cylindrical columns, the first being solid and sized to securely couple into the slightly larger hollow interior socket interface 206 of the second column. This can be a low insertion and low resistance contact. When the solid plug post 120 is mated into the hollow interior socket interface 206 an electrically conductive connection is established.

FIG. 7 depicts a plug and socket assembly just prior to mating. When the plug assembly 100 is coupled to the socket assembly 200 the spring loaded plug insulator 110 initially contacts the spring-loaded socket insulator 204. The circuit is not yet energized, and no electric current will be flowing at the initial mate. As the two assemblies are pushed together plug insulator 110 moves back into the plug assembly 100 and the electrical plug posts 120 engage with the socket interfaces 206 on the socket assembly 200. Plug posts 120 fully mate with socket connectors 206 as the plug insulator 110 recesses into the plug assembly 100 and contacts with insulating sheath 118. This configuration can prevent the exposure of plug post contacts when the plug is not engaged. The lengths of the contact posts and sockets can be sized such that the ground contact will be the first to mate and the last to break, ensuring that a ground circuit is established before electrical power is provided and still present after the electrical power is removed.

When the plug assembly 100 is pushed in to the socket assembly 200 pressing socket insulator 204 further against the nonlinear spring 208 the contacts inside the bellows mate and the load current will be flowing and the FC-72 in the bellow interior container 230 will suppress any arc. As the nonlinear spring 208 is compressed the force required to continue compressing the spring increases. At the end of the mate there are indents 292 and 106 that hold latching balls 290 to lock the plug 100 in place.

When removing the plug 100 the electrical load is removed first with the push/pull action of a ring 280 that releases the latching balls 290 on the socket assembly 200. This unlatches the plug 100 and the plug 100 is pushed out of the socket inside the bellows due the action of the non-linear spring 208. Now the electrical load is removed and the plug can be pulled out when there is no electrical load present at the contacts.

A longer length of contact engagement lowers the contact resistance that allows for more current flow. At the same time, longer contacts with higher current flow can also increases the contact temperature since the conduction travel path for the contact generated heat is longer to the bulk conductor. Using a contact with a socket on one end with the opposite end as a heat pipe reduces the contact temperature drastically, and increases the contact life.

Figure 8:
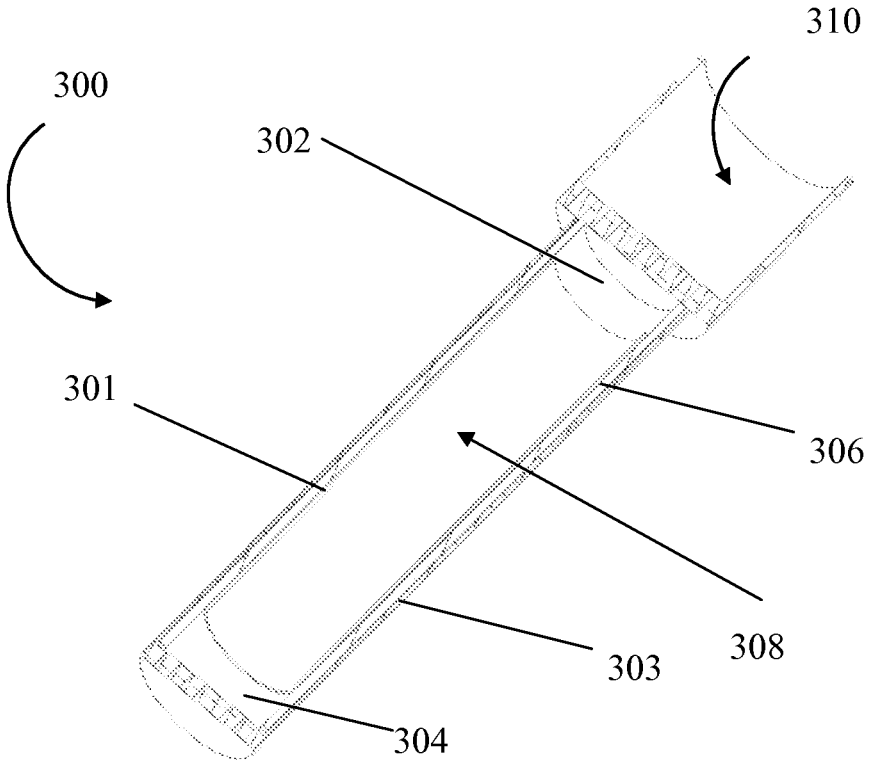
FIG. 8 is a cutaway view of a heat-pipe connector contact according to an embodiment of the invention.

An exemplary heat pipe contact 300 is depicted in FIG. 8. In one exemplary embodiment the heat pipe comprises a gold-plated beryllium-copper alloy. FIG. 8 depicts a cut-away view of the heat pipe contact 300. Two concentric thin walled pipes are fitted together with a wick 306 in between the pipes that runs the length of the pipe. The inner pipe 301 is slightly shorter in length than the outer pipe 303 and centered inside the outer pipe 303. The pipe ends are capped and sealed. One end of outer pipe is provided with a socket extension 310 for wire connection. Opposite the socket extension 310 is the contact end 304 or evaporator section. Proximate to the socket extension 310 is the condenser end 302 or wiring section. Inside the inner pipe is a hollow pipe interior 308. A small amount of heat transfer liquid such as alcohol, water, or other fluid can be introduced into 308. Due to gravity and capillary action of the wick, the liquid is transported to the evaporator section 304 at the contact end where it converts to vapor due to rise in mated contact temperature. The vapor travels to the condenser section wire end 302 where it condenses to a liquid and the processes is repeated, transferring the heat from evaporator end 304 to condenser end 302. The capillary action works against or with gravity depending on contact orientation and the amount of heat transferred due to latent heat of vaporization of the liquid. The equivalent thermal conductivity of a heat pipe contact can be more than thirty times that of a similar sized copper contact.

In another embodiment, the contact can be embedded with a heat pipe instead of making the contact as a heat pipe. Embedding a heat pipe inside the contact will create a "heat pipe to contact" thermal interface that will slightly lower the equivalent thermal conductivity, while still being a lot more efficient than a solid copper contact. Various heat pipes are available from a variety of manufacturers for different applications. (E.g. ACT-Advanced Cooling Technologies).

Figure 9:
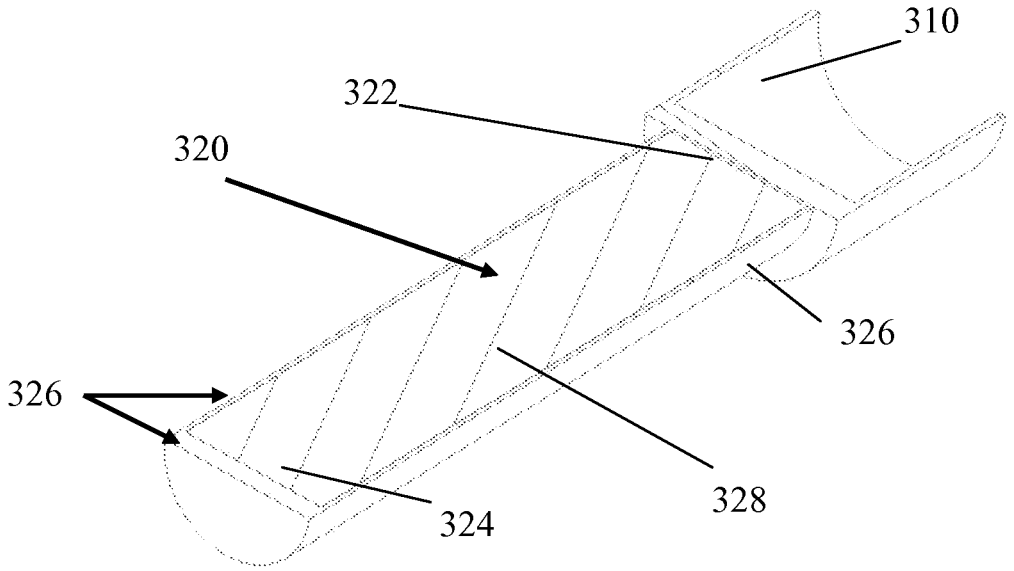
FIG. 9 is a cutaway view of a graphite embedded connector contact according to an embodiment of the invention.

In another embodiment heat pipe contact 320, as depicted in FIG. 9, includes a pyrolytic graphite material 328 such as Kcore™ (available from Thermacore) or pyrolytic graphite sheet (available from Panasonic) that is electrically conductive, is encapsulated or pressed inside the copper contact. The copper alloy contact can be sliced as shown on the sectional view of FIG. 9 and graphite material embedded in between, the halves pressed together and laser welded. Very thin copper alloy case 326 can completely envelope the pyrolytic graphite forming the exterior of contact 320. Heat goes from hot end 324 towards the cold end 322. One end is provided with a socket extension 310 for wire connection. The density of pyrolytic graphite (or Kcore) is much lower than copper and the directional thermal conductivity much higher. This results in thermally superior contact 320 with a much lower contact weight irrespective of contact orientation.

Figure 10:
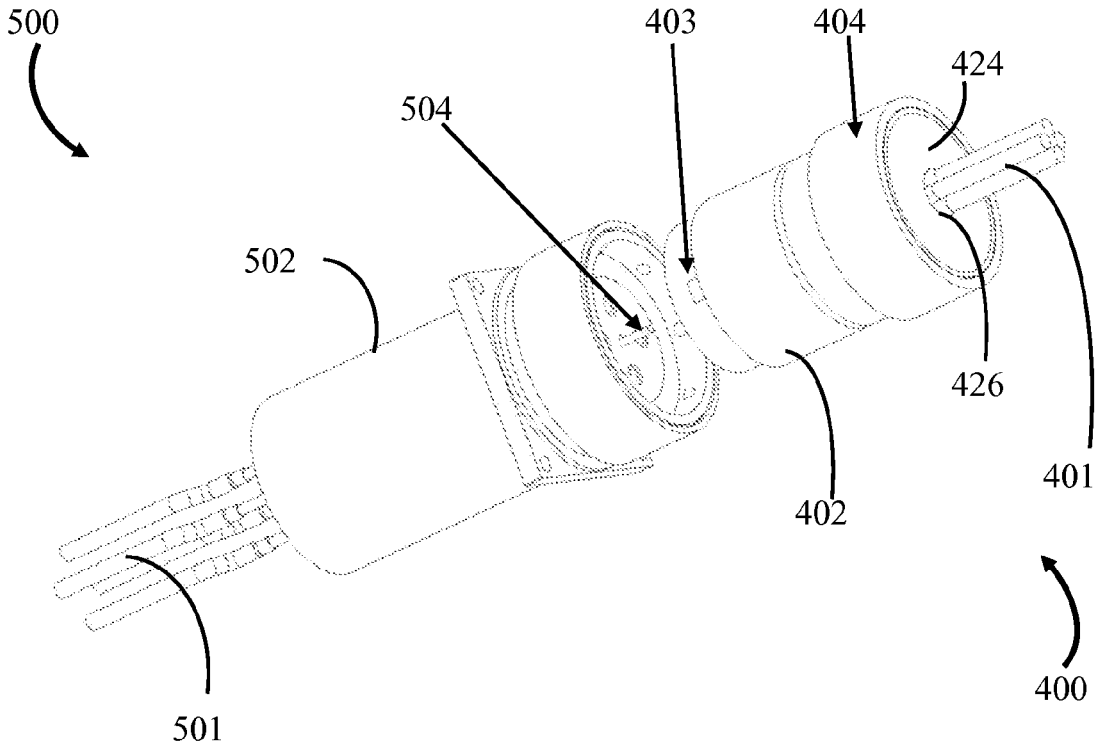
FIG. 10 is a perspective view of a separated socket and plug connector system according to an embodiment of the invention.

FIG. 10 depicts an exemplary embodiment of a multi-pin connector system including a plug assembly 400 and a socket assembly 500. The plug assembly 400 and a socket assembly 500 are depicted just prior to initial contact, and with their respective electrical cables, 401 and 501 respectively, extending from the back end of plug assembly 400 and a socket assembly 500 respectively. Socket wiring cables 501 can be connected to the power source and the plug wiring cables 401 can be connected to an electrical load. Plug assembly 400 includes an outer plug housing 402 and plug housing key 403 that mate with socket assembly 500. Socket assembly 500 includes an outer socket housing 502 and socket connector key 504 that assist in orienting the plug assembly 400 and socket assembly 500 as they mate together. Back cover ring 404 is an annular handle mounted on the rear end of the plug housing 402, and provides a handle for grasping the plug assembly 400. Back cover ring 404 can provide an attachment point for back shell assemblies (not depicted) that can help to protect the plug wiring 401. The plug assembly 400 can include a rear insulator 424 that forms opening 426 to provide a passageway from the electrical wire or cable 401.

Figure 11:
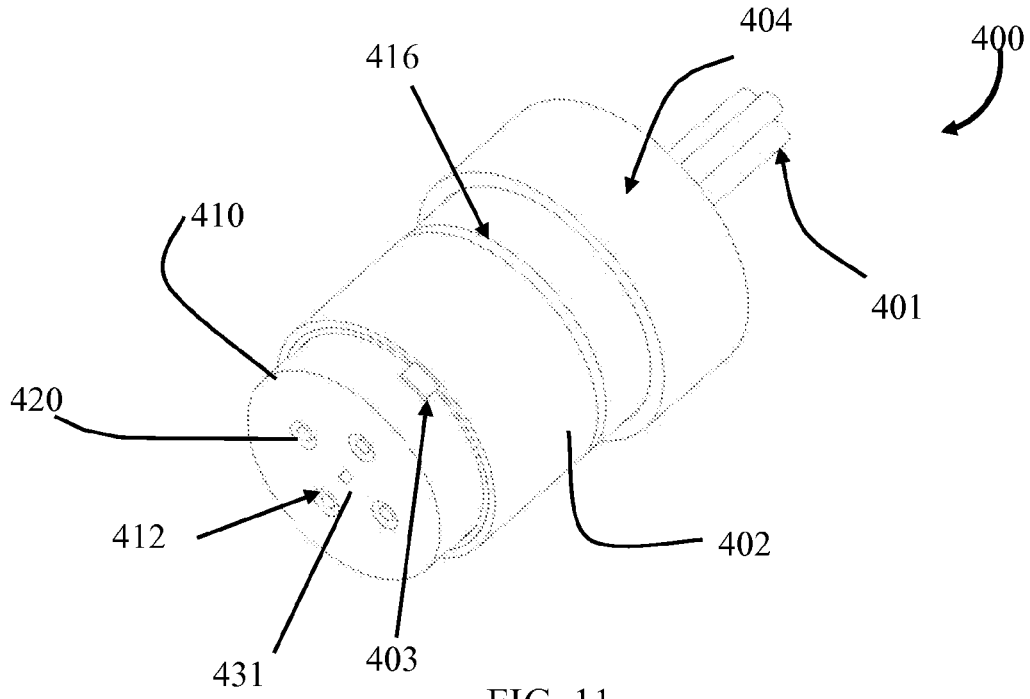
FIG. 11 is a front perspective view of a connector plug assembly according to an embodiment of the invention.

Referring to FIG. 11 a plug assembly 400 can include an outer plug housing 402, a back cover ring 404 and a locking detent 416. Locking detent 416 can comprise a groove on the plug housing 402 to latch the plug assembly 400 to the socket assembly 500 when plug assembly 400 is inserted into the socket assembly 500. Plug assembly 400 also includes a plug insulator 410 positioned within the outer plug housing 402 that forms four post openings 412 for four electrical plug posts or contacts 420. Plug insulator 410 can include a center key slot 431 sized and shaped to mate with socket connector key 504 of socket assembly 500. The key slot 431 is depicted as a half-moon, ensuring that the socket assembly 500 and the plus assembly 400 can only be mated in a single orientation, although other appropriate shaped keys can be utilized.

Figure 12:
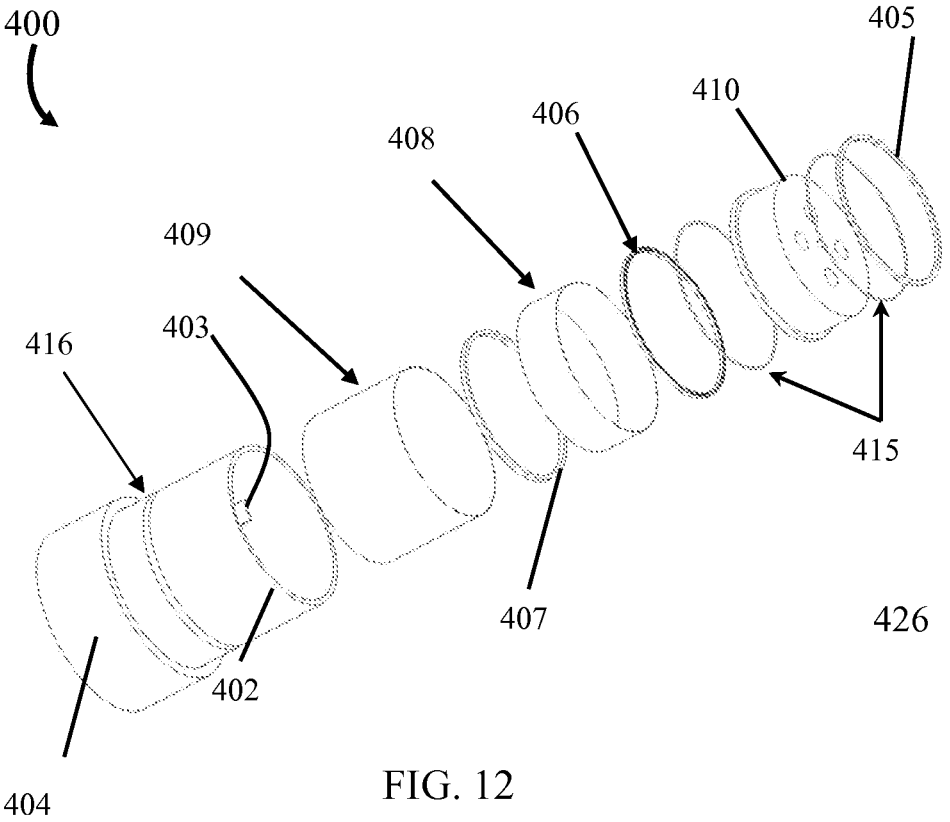
FIG. 12 is an exploded perspective views of a disassembled connector plug assembly according to an embodiment of the invention.

FIG. 12 depicts an embodiment of plug assembly 400 including three stop rings 405, 406, and 407 in the interior of housing 402. The stop rings 405, 406, and 407 are permanently attached to the housing 402 and form stoppers that can limit the movement of plug insulator 410, as will be discussed further. Insulators 408 and 409 can be Teflon or Kapton tape or sheet material (or equivalent insulator) that is attached to the interior surface of housing 402. The exploded view of the interior of housing 402, includes stop rings 405, 406 and 407. Stop rings 405 and 406 can include o-rings 415 that can form a seal when in contact with plug insulator 410 as depicted.

Figure 13:
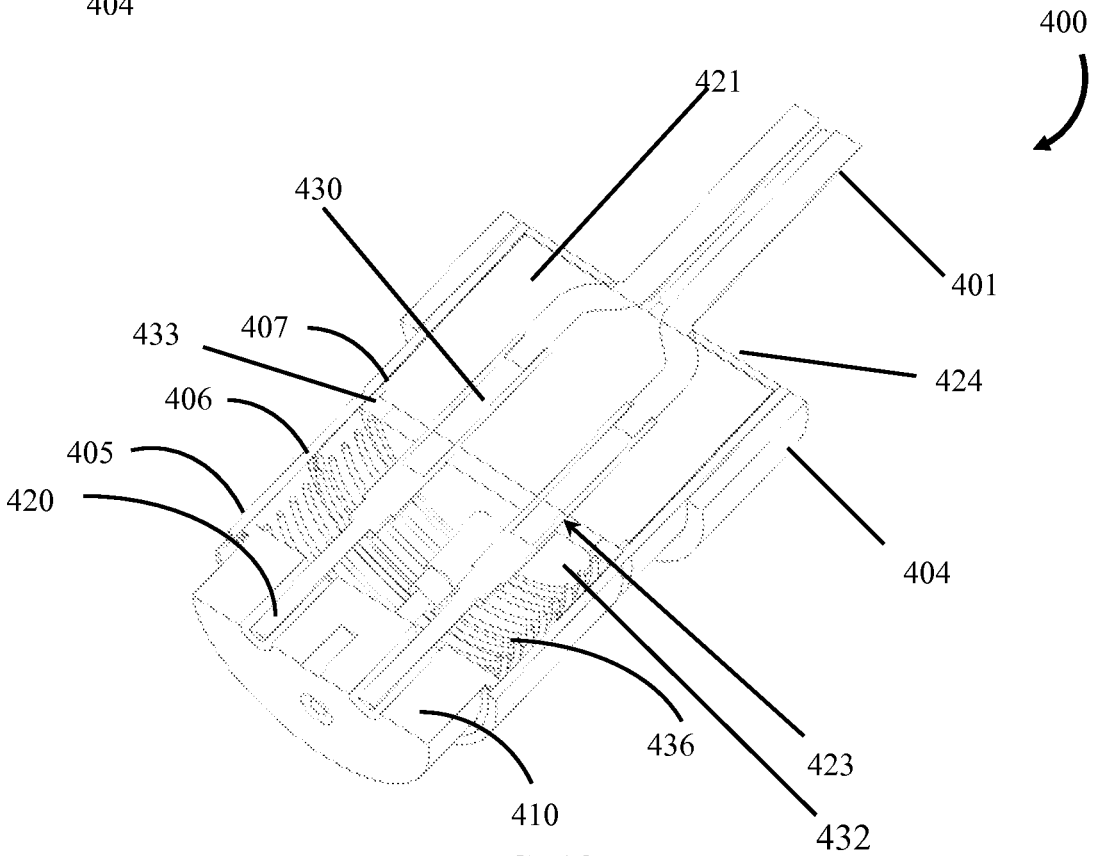
FIG. 13 is a cutaway view of the connector plug assembly of FIG. 11

FIG. 13 is a cross sectional cutaway view of the plug assembly 400 in the unmated condition. Contacts 420 can include provision 430 which are held in place, optionally by brazing, to the ceramic dam assembly 423. Ceramic dam assembly 423 can abut stop ring 407, disposing it approximately in the center of plug housing 402. One side of ceramic dam 423 can be potted with high voltage potting 421. Spring 436 is disposed between ceramic dam assembly 423 and plug insulator 410. One end of spring 436 pushes the ceramic dam assembly 423 against stop ring 407, the opposite end of spring 436 pushes against the ceramic plug insulator 410, biasing the two assemblies away from each other. Ceramic dam assembly 423 cannot move back into the plug housing 402 past stop ring 407. Insulator 410 is pushed out towards an open end of plug housing 402. Insulator 410 is limited by stop ring 405. Insulator 410 can be sized to cover the exposed end of contacts 420 when the plug assembly 400 is not mated or otherwise in a free state. In one exemplary embodiment, the four electrical contacts 420 can correspond to circuits providing +/−300 VDC, power-ground and system-ground. The housing 402 and cover 404 can be constructed from any of a variety of materials, including, for example, metal or plastic. An exemplary ceramic dam assembly 423 can include a metal brace 433 surrounding the perimeter of a ceramic center 432.

Figure 14A:
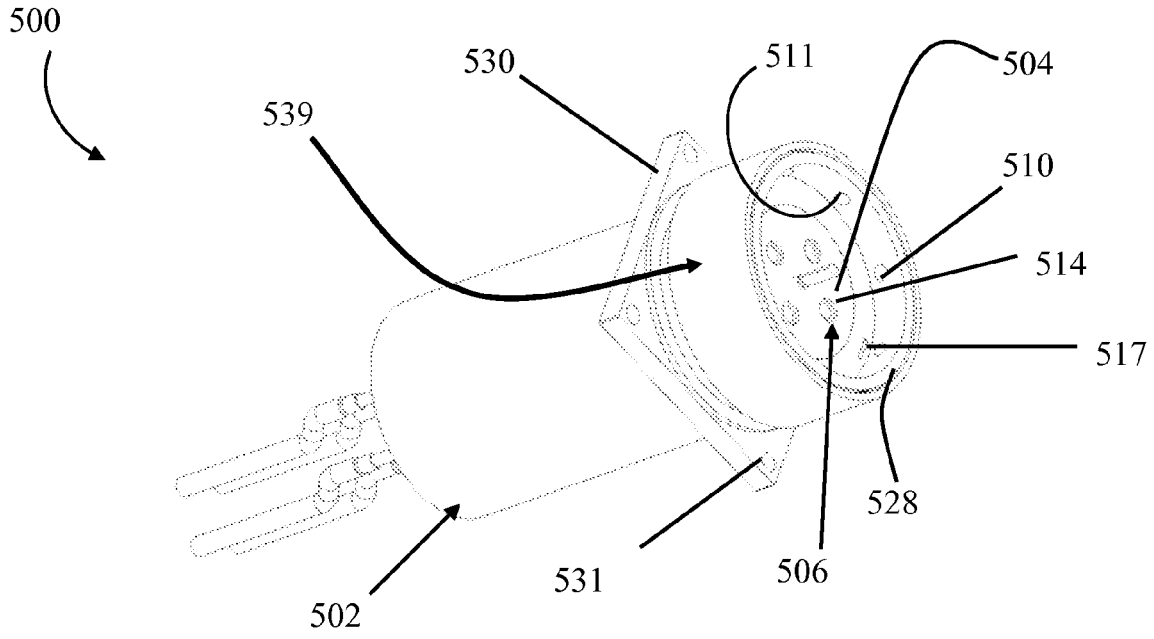
FIG. 14A is a front perspective view of a socket assembly according to an embodiment of the invention.

Referring to FIG. 14A, a socket assembly 500 can include an outer socket housing 502, a ceramic header insulator 514 and four electrical socket interfaces 506 configured to mate with the electrical contacts 420 of the plug assembly 400. Socket assembly 500 is depicted in a free or unmated state. Socket insulator 514 which is a part of the header assembly can move as an assembly into socket housing 502 when plug assembly 400 is inserted into to the socket assembly 500. The outer socket housing 502 also includes a latching mechanism assembly 539 comprising a plurality of latching balls 510, a snap ring 511, and a snap ring groove 528, to allow the socket assembly 500 to releasably mate with plug assembly 400. Socket assembly 500 can include a plurality of mounting holes 531 disposed at the corners of a socket mounting flange 530.

Figure 14B:
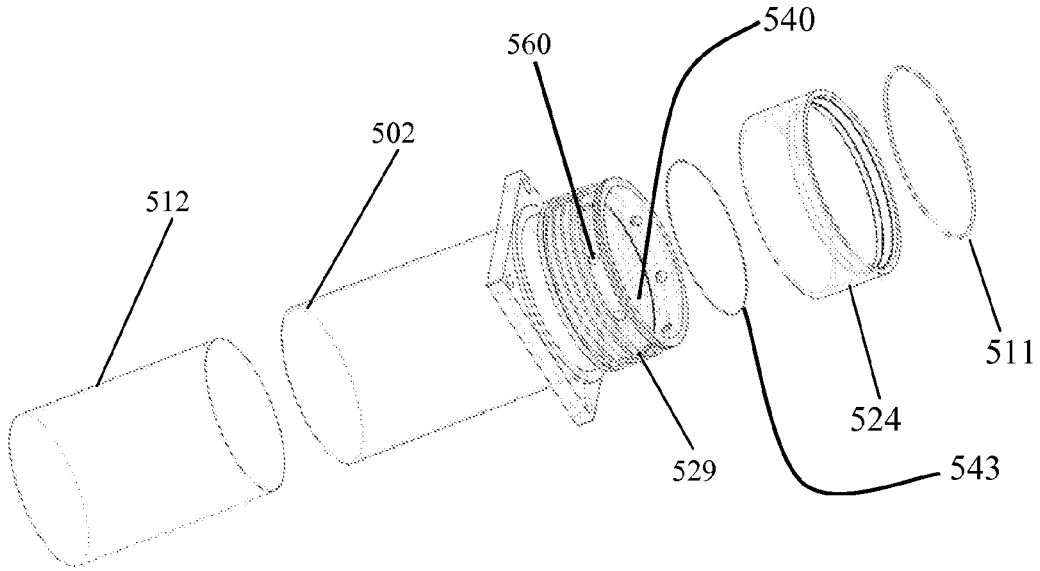
FIG. 14B is exploded view of the housing front of FIG. 14A.

FIG. 14B depict socket housing 502 with socket insulator and other internal components removed. Socket housing 502 can include an interior circular groove or recess 540 that can contain an O-ring 543 to allow the socket assembly 500 and the plug assembly 400 to securely mate together, thereby limiting the moisture, dirt, or other contaminants from entering the socket-plug interface. Latching mechanism 539 can include a ball spring cover 524 that surrounds a snap ring 511. The interior surface of socket housing 502 can be covered or coated with an insulation material 512 such as a ceramic, Teflon or Kapton.

FIG. 14B also depict socket housing 502 with ball spring cover 524 exploded and latching balls 510 removed. Spring 529 is mounted on socket housing 502 and biases the ball spring cover 524 such that the latching balls 510 are retained in holes 560.

Figure 15A:
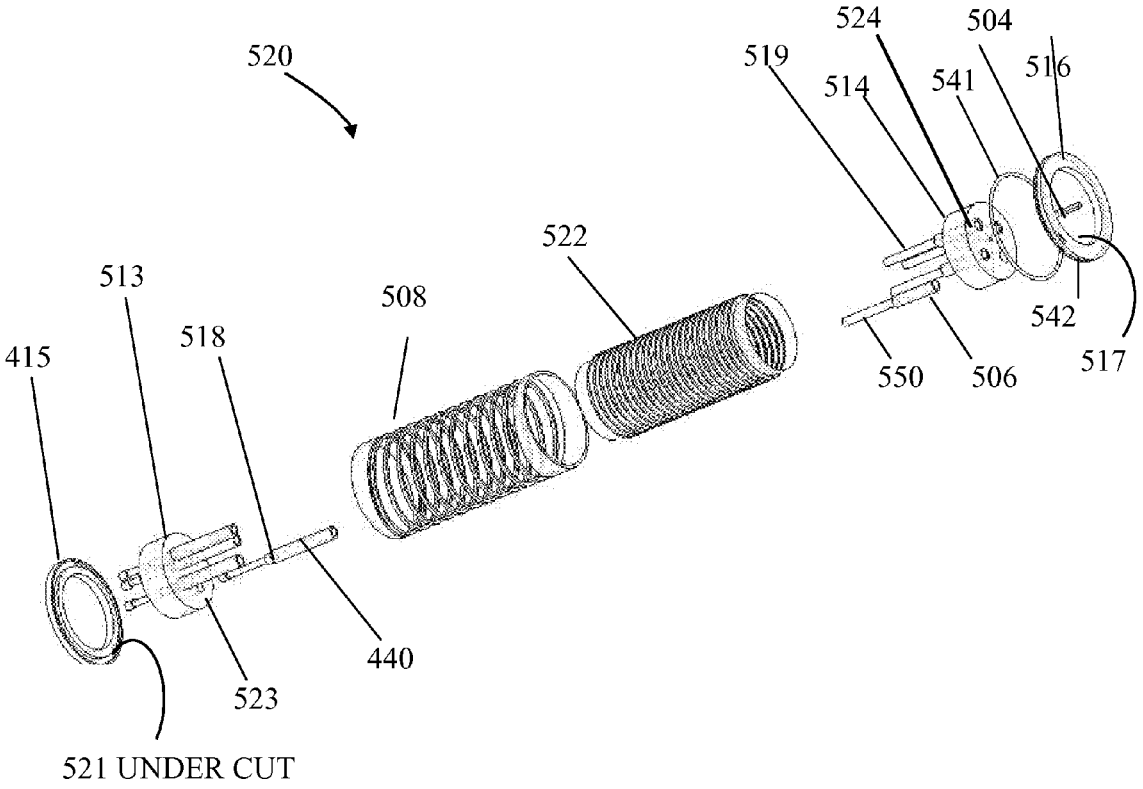
FIG. 15A is a perspective and exploded view of an interior bellows assembly of the connector socket assembly of FIG. 14A.

FIG. 15A depicts a socket assembly 500 with the outer socket housing 502 removed. Referring to FIG. 15A, the bellows assembly 520 of the socket assembly 500 can include a hollow bellows 522 that is sealed at one end by a header assembly 548, and a second header assembly 549 at the opposite end. An exterior machined compression spring 508 surrounds the underlying bellows 522, and is biased to expand the bellows 522 in the outward direction by pushing header assembly 548 and second header assembly 549 apart. Examples of machined compression springs are available from Helical Products Company, Inc. of Santa Maria, Calif. During compression, the spring 508 (not shown in detail, has wider bottom loops and narrower top loops) is generally soft in the beginning (easily deformed) and generally becomes harder to push (more rigid) after the initial compression. Header assemblies 548 and 549 can be brazed to the ends of metal bellow 522 with the machined spring 508 in-between the two header assemblies, as shown. The interior or exterior of bellow 522 can be coated with an electrical insulation depending on the material that bellows 522 is constructed from.

The bellow 522 and header assemblies 548, 549 together provide an interior container 580 that can be filled with inert electronic liquid such as Fluorinert (trademark 3M), perfluorohexane (FC-72), or a similar fluid equivalent depending on the expected operating temperature requirements of the connector assembly. Various fluids, such as FC-72, FC-77, FC-84, FC-87, and other similar fluids, can be mixed together in varying proportions to provide a suitable fluid based on the desired boiling point or high voltage capacity characteristics necessary to accommodate specific operating conditions.

Figure 15B:
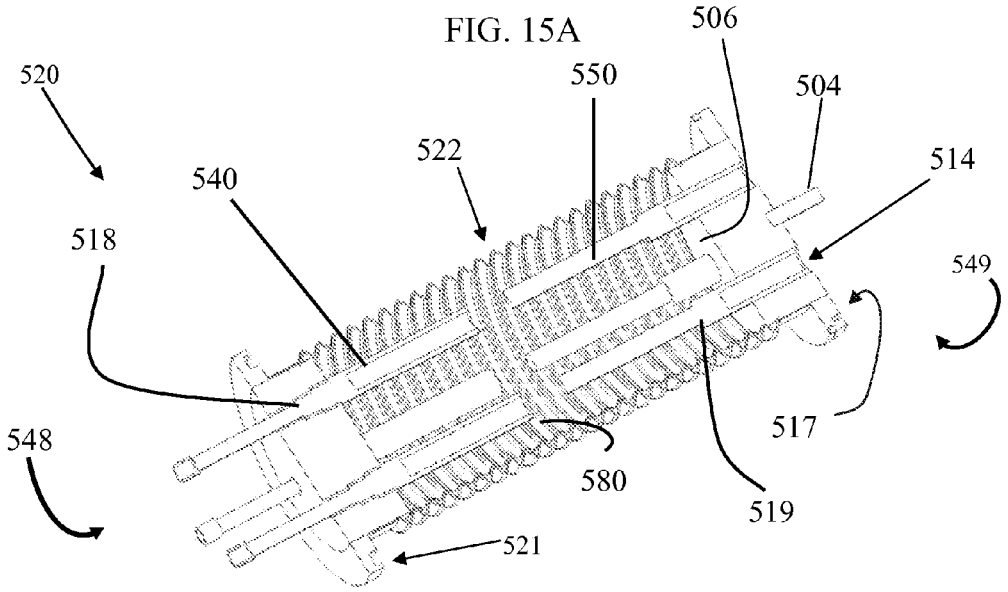
FIG. 15B is a cutaway view of the bellows headers and contacts of the interior bellows assembly without the machined spring of FIG. 15A.

Referring to exploded view of FIG. 15A and cut view of FIG. 15B, header assembly 548, and header assembly 549 can include one or more sets of contacts 518 and 519 that are sized to releasably mate and form an electrical connection. Contacts 519 include an electrical socket interface 506 as depicted in FIG. 15B.

Referring to FIG. 15A, header assembly 548 includes an outer ring 515 surrounding a ceramic header 513. Ring 515 can be constructed of a metallic material and include a recess 521 sized to accept the spring 508 that locates the spring with a gap around the bellows. Header assembly 548 includes via 523 configured to contain one or more sets of contacts 518.

Header assembly 549 includes a perimeter ring 516 that can include a key slot 517 sized to receive plug housing key 403. Perimeter ring 516 surrounds a ceramic header 524 and includes a header groove 542 sized to accept an o-ring 541. Header assembly 549 includes via 524 configured to contain one or more sets of contacts 519 and socket connector key 504.

Referring to FIG. 15B, a cutaway view through the center axis of unexploded assembly 520 of FIG. 15A, without the 508 spring, the bellows assembly 520 defines a space 580 for an inert liquid within interior bellow 522. The interior container is generally filled with a quantity of fluid sufficient to immerse the contact-plug 550 of contacts 519 and contact-socket 540 of contacts 518, in a fluid regardless of the orientation of the socket assembly 500. In one embodiment the interior is not completely filled with fluid in order to provide sufficient space for expansion of the fluid due, for example, to an increase in operating or ambient temperature. When the bellow 522 is compressed under a mated condition, the fluid can nearly fill the bellow, leaving a relatively small free space. In one embodiment, less than fifteen percent of the available volume inside bellow 522 is free space. The free space can provide for fluid expansion for high temperature operation without stressing the bellows excessively.

The bellows assembly 520 when installed in 502 can function as a guide mechanism to ensure that the electrical contacts 518 and 519, disposed at opposite end of the bellows assembly 520 are properly aligned when the two header assemblies 548, 549 are forced together. Additional environmental seals, o-rings, or other synthetic rubber or fluoropolymer elastomer seals can be included in either the socket assembly 500 or the plug assembly 400 to prevent the introduction of external elements into the assembly or the escape of the inert fluid.

The contacts 518 and 519 can generate heat when mated, due to contact resistance. The generated heat can create hot spots on the mated portions of contacts, contributing to contact erosion. Low insertion force and low resistance contacts such as Amphenol Radsok can reduce the temperature rise.

An inert fluid, such as FC-72, generally does not have high thermal conductivity. Adding diamond dust to FC-72 fluid can enhance its equivalent thermal conductivity. Diamonds can have thermal conductivity approximately five to ten times greater that of copper. The diamond dust can be included to the fluid inside bellow 522 and circulate between the mated contacts 518 and 519 and the metal bellow 522, transferring the heat to the bellows. The bellows 522 can be fabricated out of copper enabling better heat spreading and heat transfer from contacts 518 and 519 to the bellows 522. The bellow 522 can be brazed to the header 548 which is in contact with the housing 502. The outer ring 515 of header 548 can be made of a tungsten copper alloy to provide thermal conductivity and for ceramic expansion matching. The ceramic 513 of header 548 can be of Aluminum Nitride or other ceramic that have higher thermal conductivity. Thus generated heat is better dissipated to the ambient atmosphere from housing 502, in addition to transferring the heat through the mated contact to the bulk wire. Header assembly 549 can be of similar construction. Overall effect is lowering of contact temperature rise and increasing the contact life. To protect the assemblies and their internal components from harsh environments, O-ring seals made of Viton can be included in plug assembly 400, the socket assembly 500, and the header assembly 549.

Figure 16:
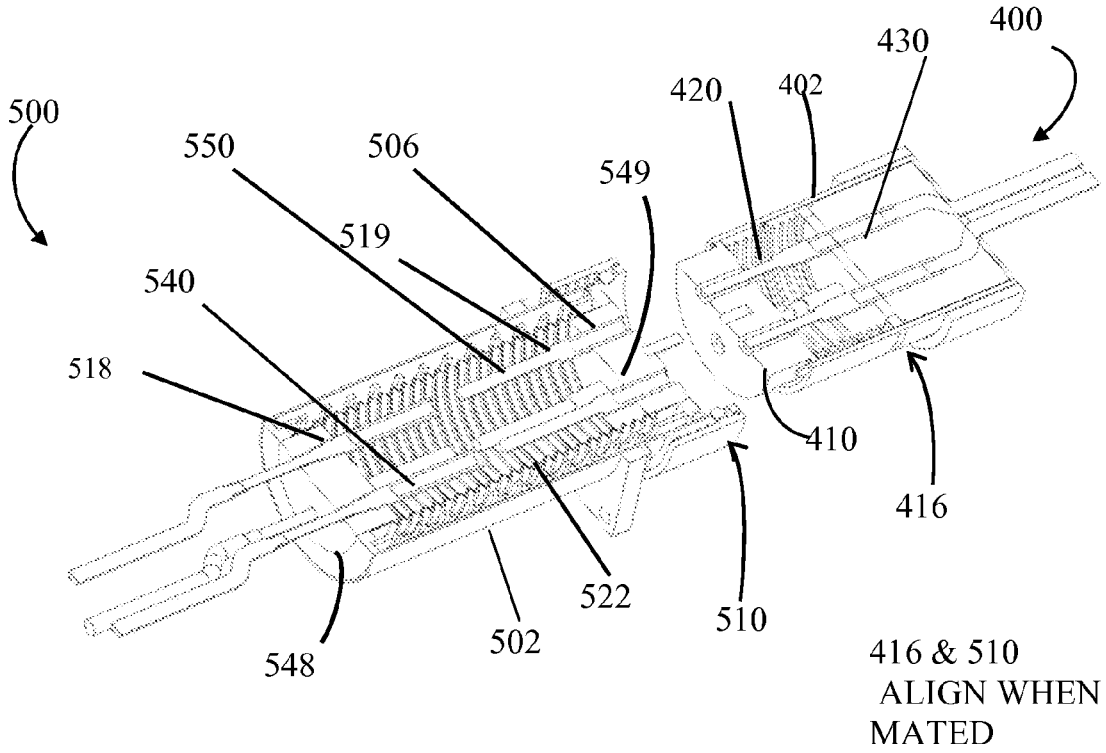
FIG. 16 is a cutaway view of the separated socket and plug connector system of FIG. 10.

FIG. 16 depict a plug and socket assembly cut view just prior to mating. Header assembly 548 can be fixed (laser welded) to one end of socket housing 502. Header assembly 549 is free inside the housing 502 with a snug fit against the interior surface of housing 502. The interior of housing 502 can be Teflon or Kapton coated to prevent the header assembly 549 from binding. Contact-plug 550 of contacts 519 and contact-socket 540 of contacts 518 are generally submerged in an inert fluid.

Figure 17:
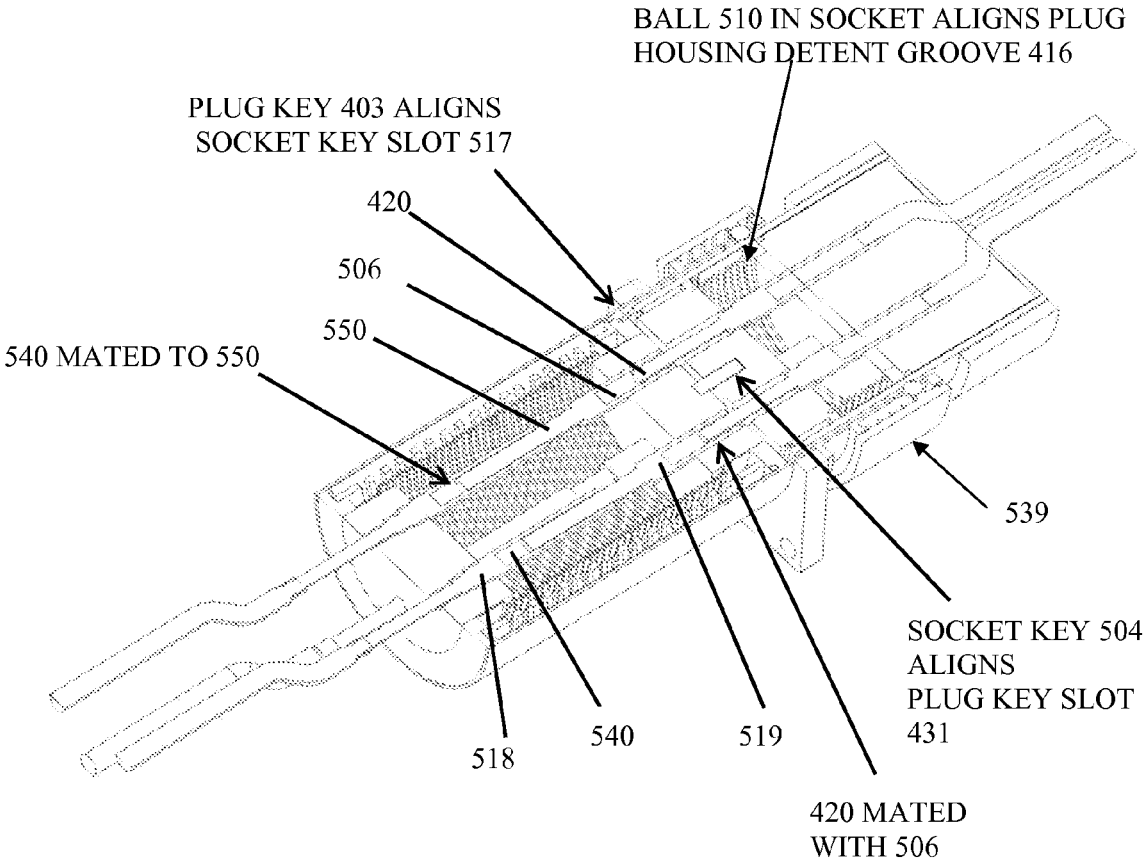
FIG. 17 is a cutaway view of the connected socket and plug connector system of FIG. 10.
Figure 18:
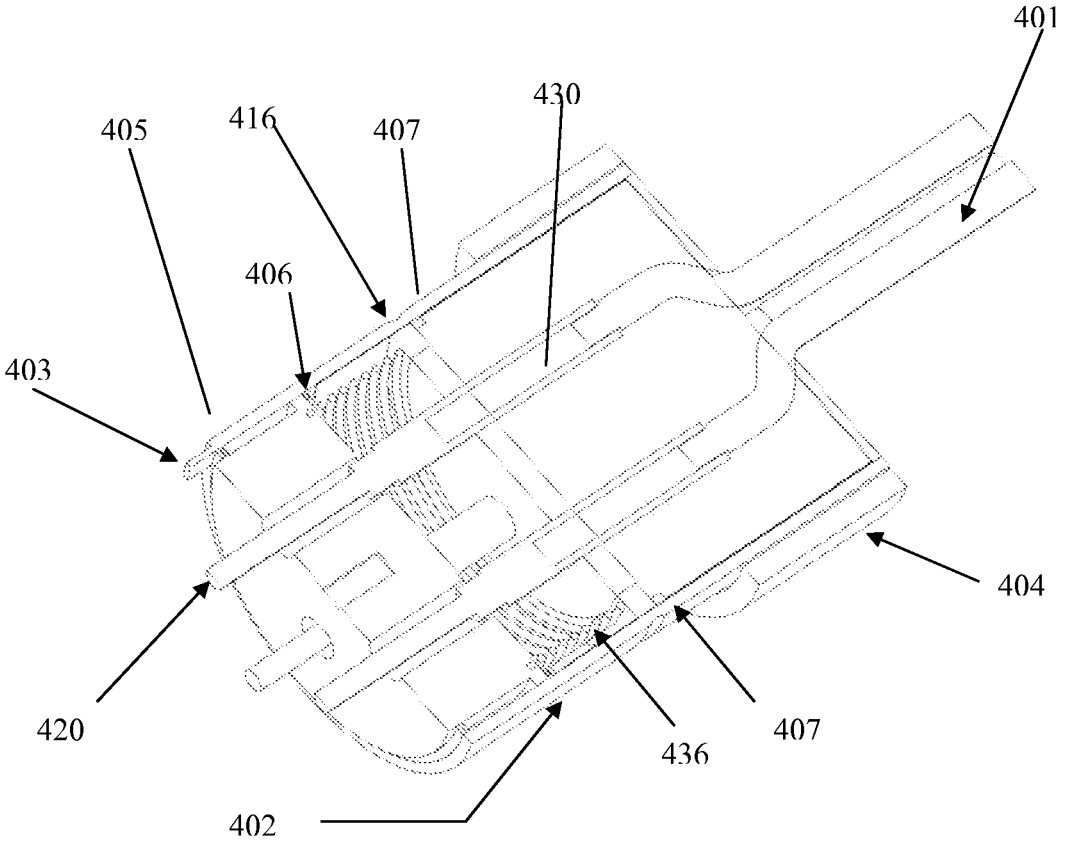
FIG. 18 is a cutaway view of a connector plug assembly (when mated) according to an embodiment of the invention.

FIG. 17, shows a cross sectional view through the center axis of the mated assemblies. FIG. 18 is a cutaway view of the plug under mated condition showing the contacts exposed. When plug assembly 400 is inserted into socket assembly 500, plug insulator 410 moves back into plug housing 402, and the contact 420 mates with electrical socket interface 506 of contact 519. No load current flows through the system at this condition. When plug assembly 400 is further pushed into socket assembly 500, the spring 508 and the bellows 522 compresses together. Contact-plug 550 of contact 519 engages with contact-socket 540 of contact 518. Contact-plug 550 of contacts 519 and contact-socket 540 of contact 518 are completely submerged in an inert fluid contained in bellow 522. Electrical load current will pass through the system when contact-plug 550 and contact-socket 540 mate.

In a similar manner, when the plug assembly 400 is removed from socket assembly 500, the contact between contact-plug 550 and contact-socket 540 is broken within the bellows 522 first, with the contact-plug 550 and contact-socket 540 that are submerged in fluid. After further pulling, the contact 420 disengages from electrical socket interface 506 of contact 519.

When the plug assembly 400 is inserted into socket assembly 500, the balls 510 extending inside the socket housing 502 prevent the plug housing 402 from going in any further. Pushing the ball latch cover 524 manually toward the flange 530 (against the force of latch spring 529), releases the balls 510 to move up. The balls 510 are trapped under latch cover 524 and cannot fall out. Then housing 402 travels further inside the socket housing 502, forming an electrical connection as described above. Releasing latch cover 524 releases the balls 510, but the balls 510 cannot impede the travel of plug assembly 400. On further pushing of the plug 400, bellows contacts 518 and 519 are mated completely and the groove 416 on the plug housing 402 is located under the balls 510. When the groove 416 gets under the balls 510 the latch spring cover 524, under pressure from spring assembly 529, pushes the balls 510 into the groove 416. Part of the balls 510 drop into the groove 416 to releasably latch plug housing 402 to the socket housing 502 To release the plug assembly 400 the ball latch cover 524 is pushed toward the flange and the plug is pulled. Plug moves out because the balls 510 are free. When plug housing 402 is completely out the balls 510 falls back on the hole in the socket housing 502 and the ball latch cover 524 springs back. Ball latch cover 524 cannot come out as the snap ring 511 blocks 524 from coming out of the assembly 500. As long as the snap ring 511 is in place the balls are trapped under cover 524.

Figure 19A:
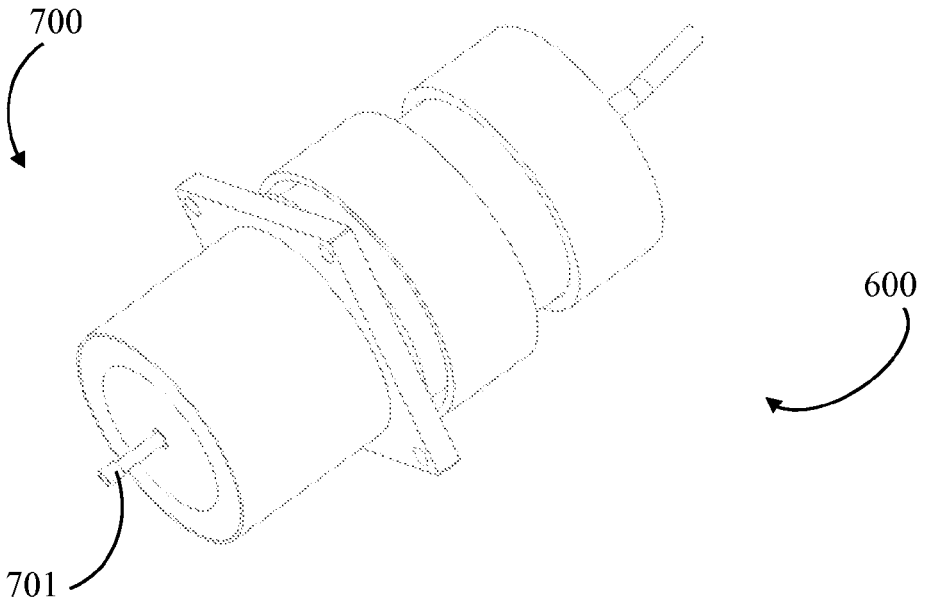
FIG. 19A is a view of mated socket and plug assemblies according to an embodiment of the invention.
Figure 19B:
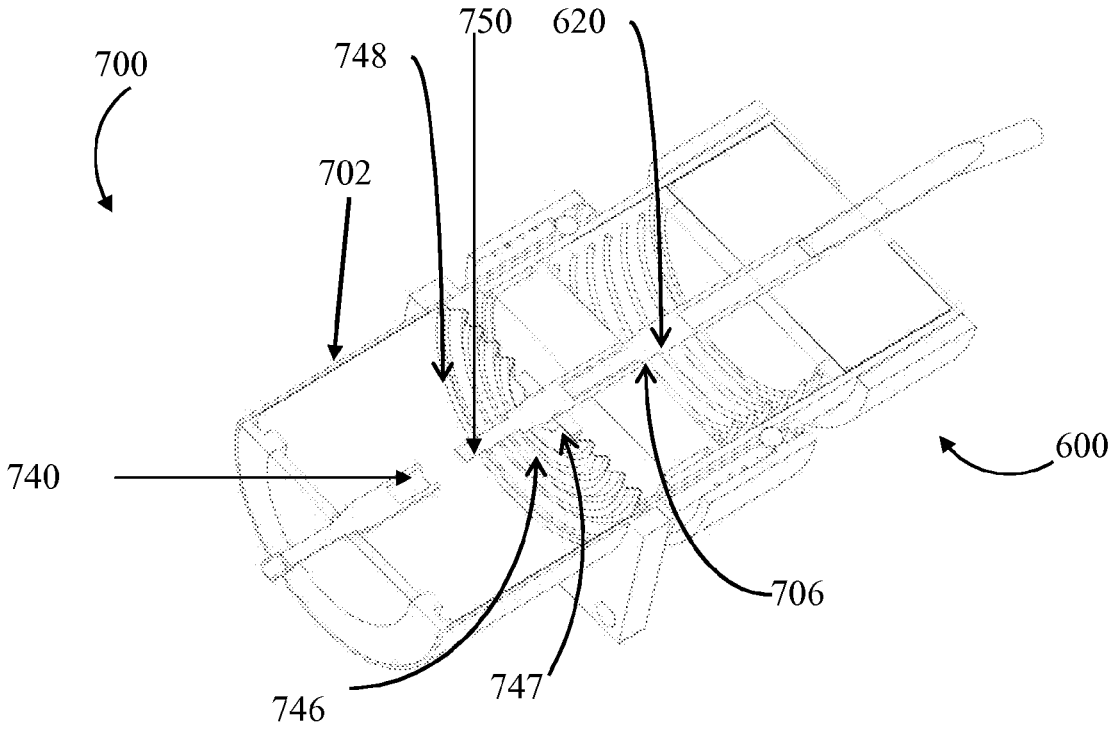
FIG. 19B is a cutaway view of the mated socket and plug assemblies of FIG. 19A.
Figure 19C:
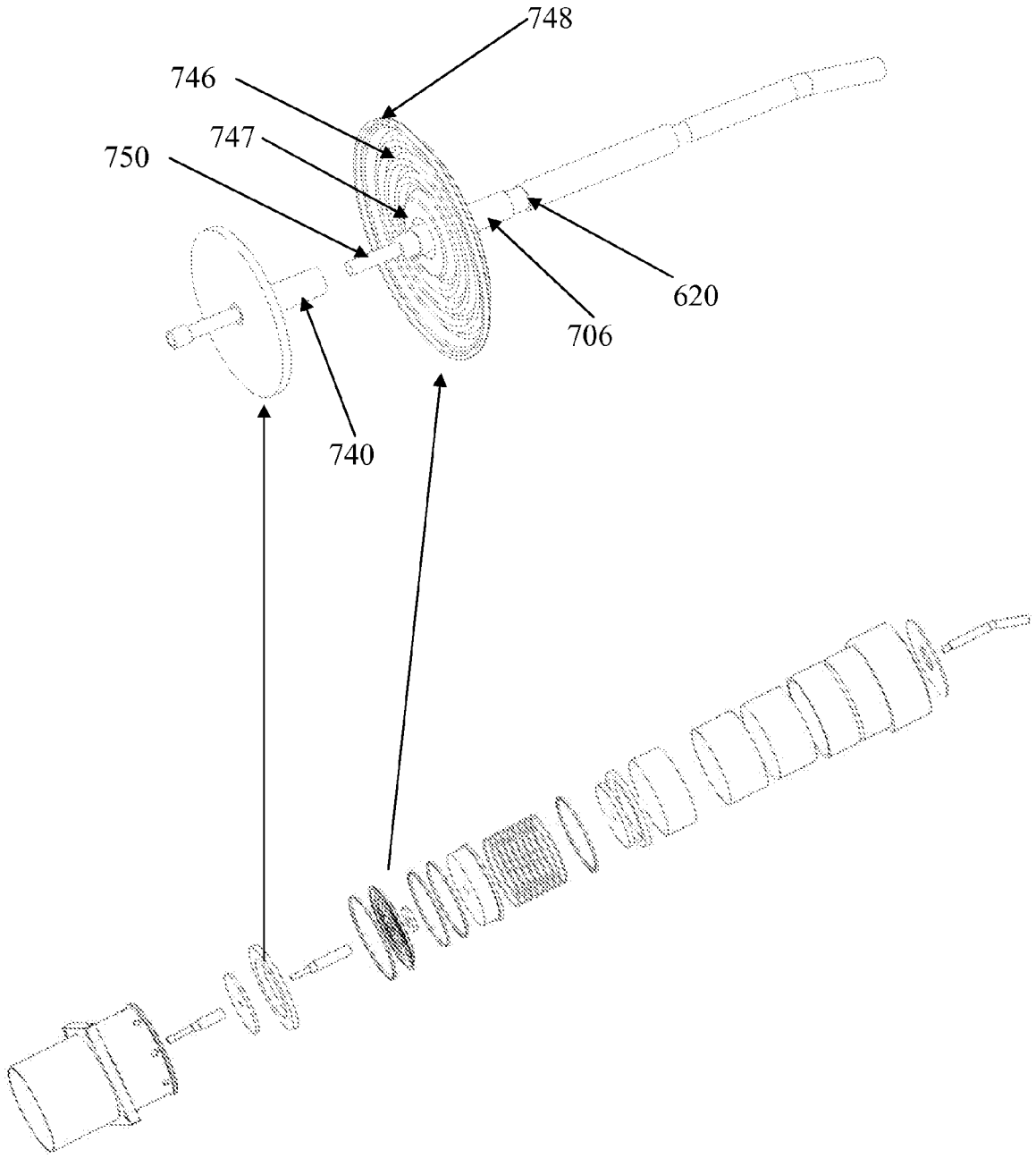
FIG. 19C is an exploded view of the connector assembly of FIG. 19A.

Referring to FIG. 19A-19C, disclosed is another embodiment of a plug assembly 600 and a socket assembly 700 which include a single pin contact 701. The corrugated foil diaphragm 746, depicted in FIG. 19C can be made of a high strength nickel-iron-chromium or nickel-iron-chromium-titanium metal alloy (e.g. Ni-Span-C) to provide a deflection for short contact mating for high voltage applications with a generally lower current requirement with a ceramic center ring 747 and perimeter metal ring 748. The center ring 747 can be a ceramic brazed to contact 706, metal ring 748 can be laser welded to the housing 702 of socket assembly 700.

In another embodiment not shown, to get more deflections for high-current, high-voltage contacts, elastomeric diaphragms EPDM/3499 can be bonded between ceramic center ring 747 and bonded metal edge ring 748. This alternative assembly can be used with appropriate safety precautions incorporated for high voltage application.

A captive inert fluid, e.g. FC-72 or equivalent, that suppresses high voltage arcing, can be retained in housing 702 between the rear end and diaphragm 746. After initial no load contact between 620 with 706, the connection of contact 750 and contact 740 can be fully immersed in the inert fluid when forming an electrical circuit.

Figure 20:
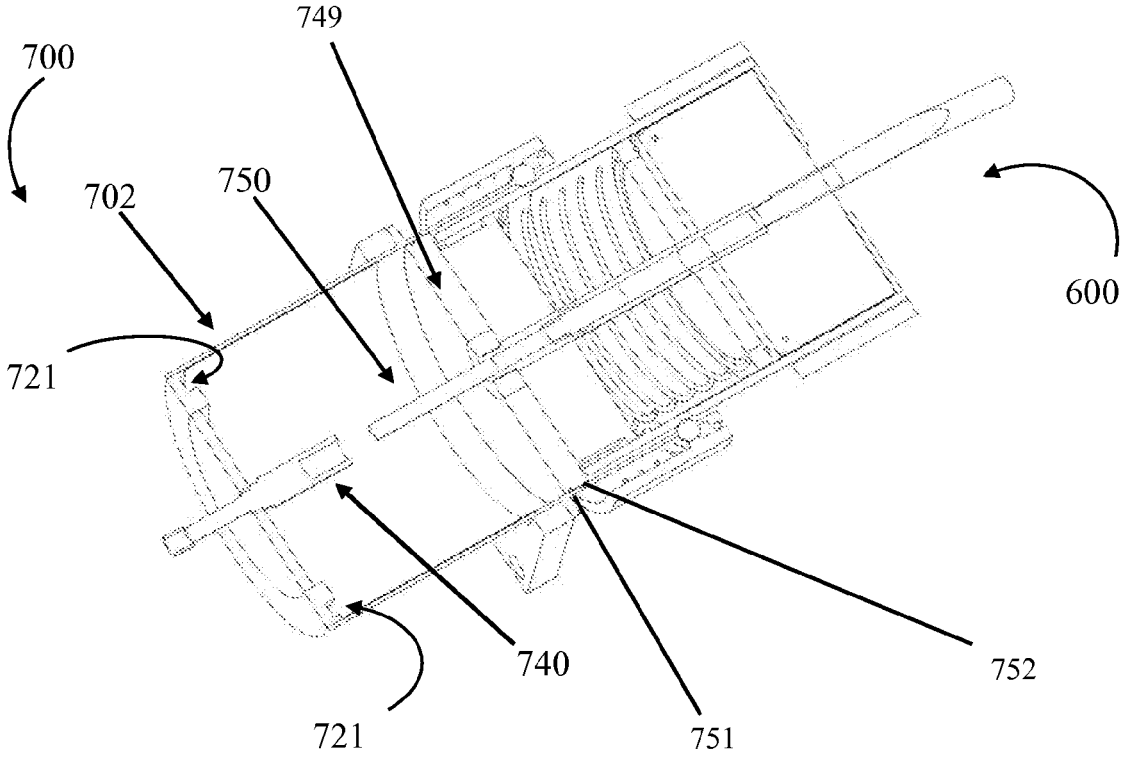
FIG. 20 is a cut away view of a socket assembly with a plunger receiving a plug assembly according to an embodiment of the invention.

Referring to FIG. 20, which is a cutaway view of a similar connector as the FIG. 19A assembly, except a plunger with o-rings seals as in hydraulic quick disconnects are used instead of a diaphragm. A machined spring located at groove 721 that biases against the plunger is not shown. The socket assembly 700 of a hydraulic quick disconnect can be modified to support contacts on one end where it can be attached to a power supply box. The socket assembly 700 can be configured to permanently hold the inert fluid. O-ring seals (751 and 752) and a plunger assembly 749 on the end of socket assembly 700 seal the fluid in assembly housing 702, a hydraulic quick disconnect male end modified, for electrical contact. When engaged or disengaged the no spill hydraulic quick disconnect with electrical contact is achieved.

Another embodiment is where the plug is always connected to the load and the socket is always connected to the power source with an adapter in between. Turning the adapter controls the power. This is needed when the power has to be turned off without unplugging the load plug. It is also safer to use this approach (eliminating manual plugging and unplugging) in high voltage applications.

Figure 21A:
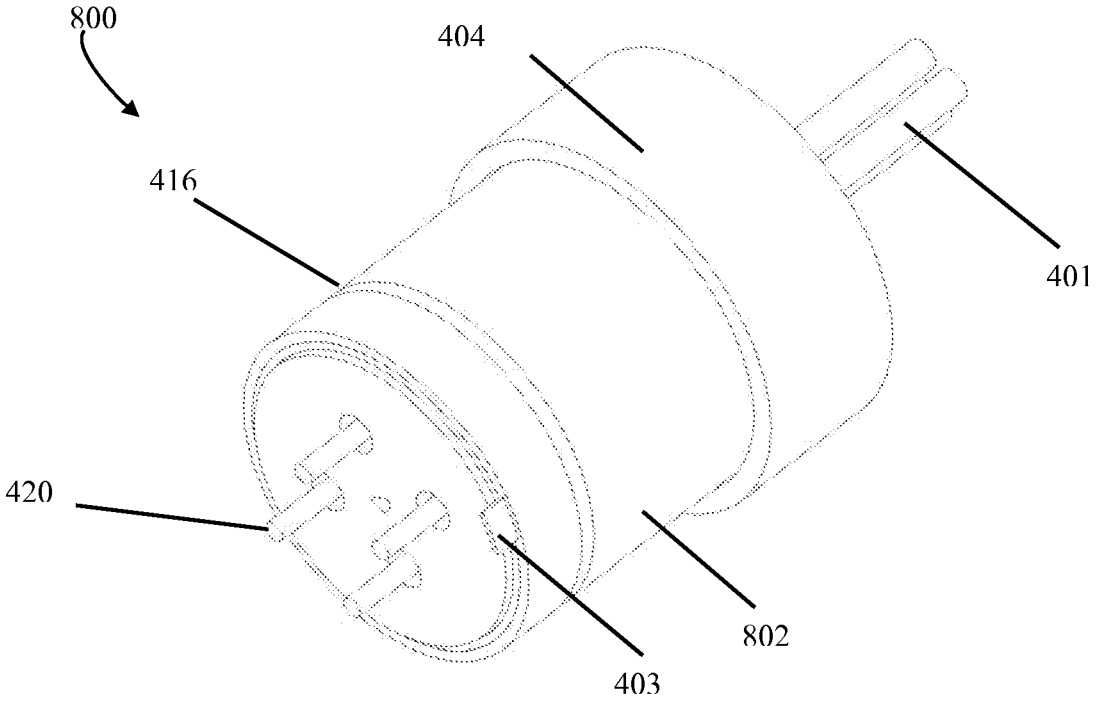
FIG. 21A depicts a plug with a post contact according to an embodiment of the invention.
Figure 21B:
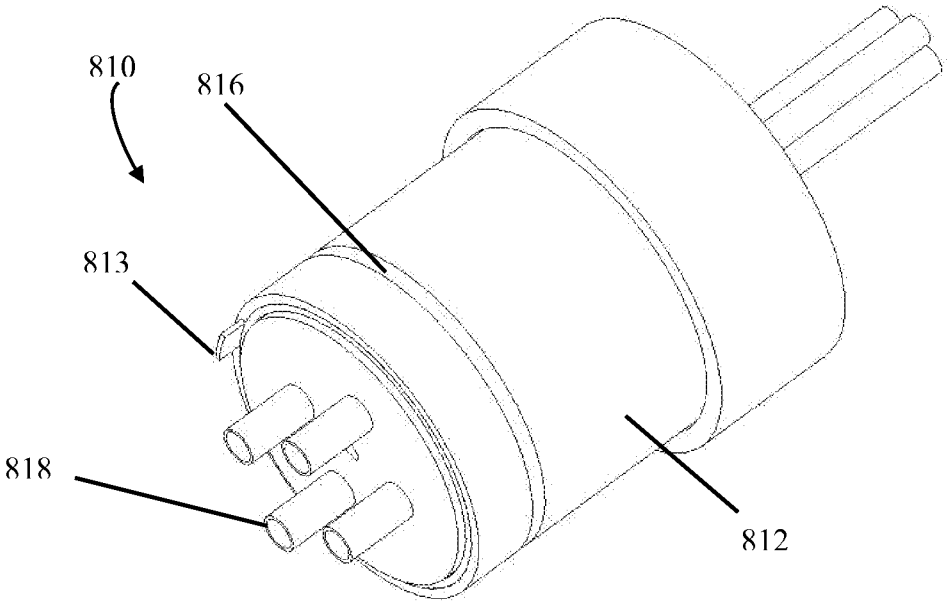
FIG. 21B depicts a mating socket according to an embodiment of the invention.
Figure 23A:
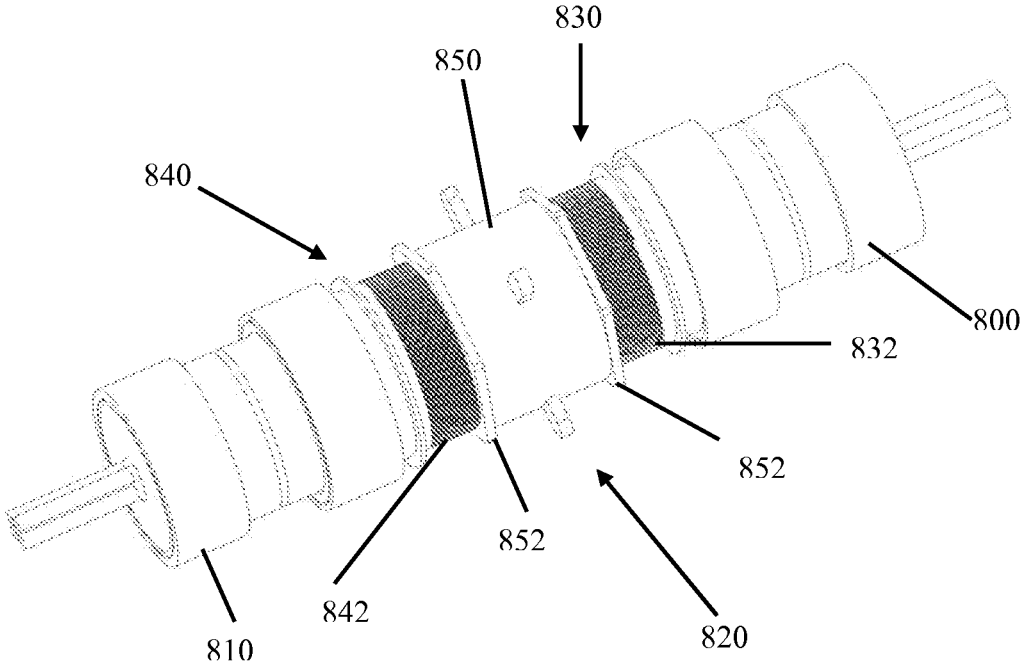
FIG. 23A depicts the unmated adapter of FIG. 21C assembled with plug of FIG. 21A and socket of FIG. 21B.
Figure 23B:
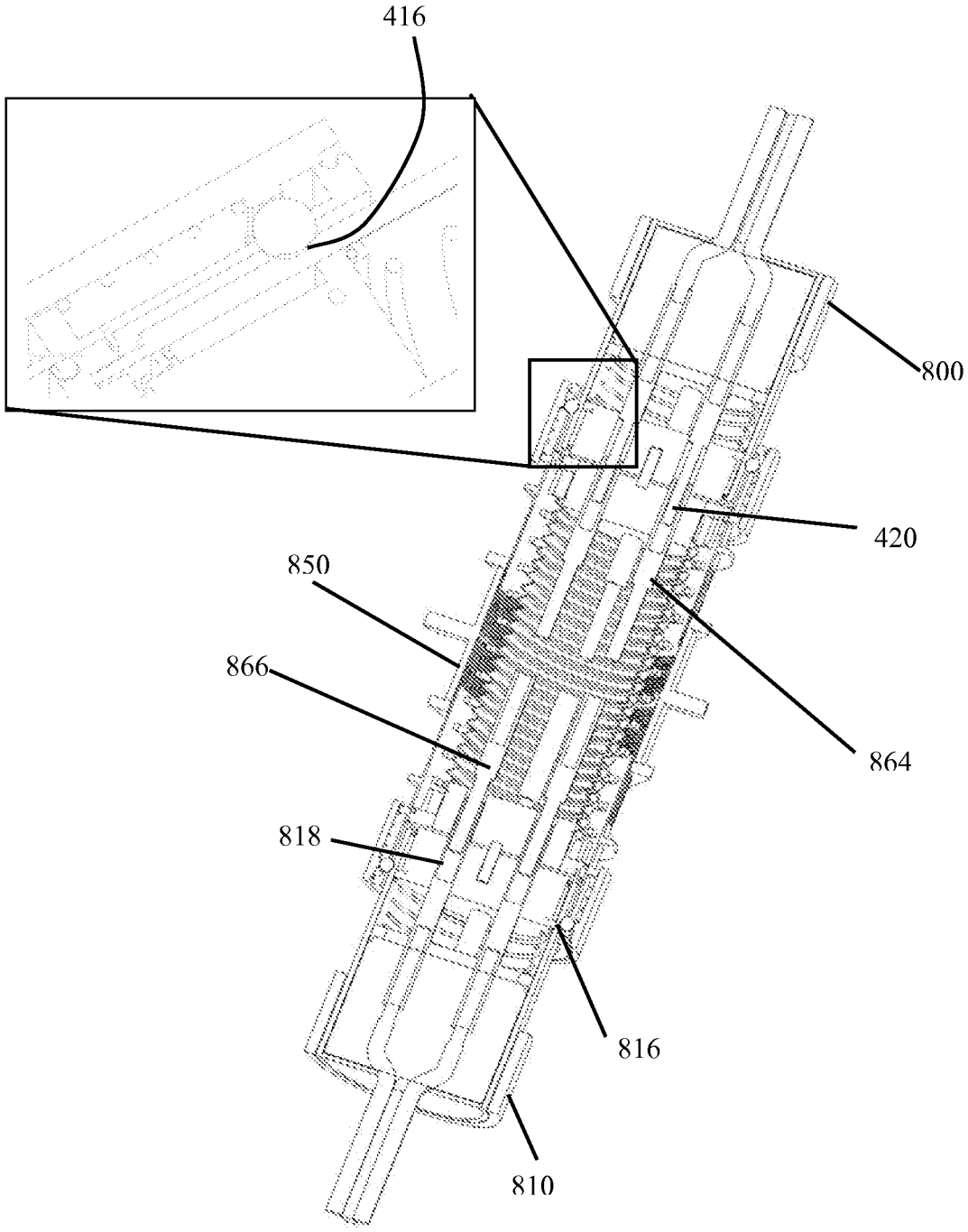
FIG. 23B depicts a cutaway view of the assembly depicted in FIG. 23A.

FIG. 21A shows an embodiment of a plug assembly 800 with post contacts. The interior components of assembly 800 are similar to plug assembly 400 as shown in FIG. 13. FIG. 21B shows an embodiment of a socket assembly 810. Interior components of socket assembly 810 are similar to the socket assembly 500. An adapter assembly 820 shown in FIGS. 21C and 21D can couple plug assembly 800 with socket assembly 810. FIGS. 23A and 23B depict a plug assembly 800, the socket assembly 810, adapter assembly 820 mated together wherein the adapter facing the plug 830 and the adapter facing the socket 840 are depicted.

The plug assembly 800 includes an outer plug housing 802 and plug housing key 403 not shown that mates with an adapter assembly 820. In a similar fashion socket assembly 810 includes an outer plug housing 812 and plug housing key 813 that mates with one end of the adapter 820. Locking detent 416 is used for latching the plug assembly 800 to the adapter 820. Similarly locking detent 816 is used for latching the socket assembly 810 to the opposite end of the adapter 820. The plug assembly 800 includes post contact 420 and the socket has open socket contact 818 that can accept the post 420.

Figure 21C:
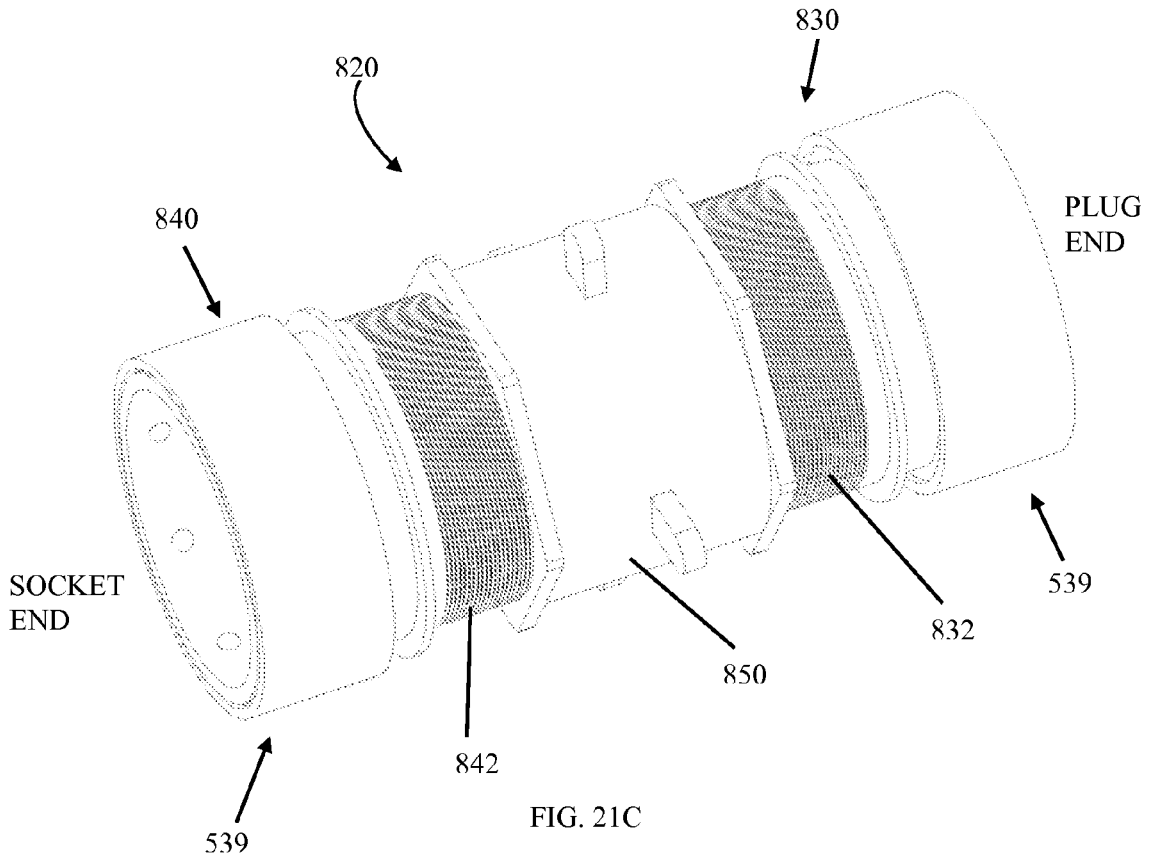
FIG. 21C depicts an adapter configured to couple the plug of FIG. 21A with the socket of FIG. 23B according to an embodiment of the invention.

The adapter shown in FIG. 21C has two separate housing 830 and 840 joined with a turning ring 850. The housing has a latching assembly 539 on each end. One end connects to plug and the other end connects to socket. The latching mechanism assemblies 539 are generally the same as that disclosed in FIGS. 14A-14B.

Figure 21D:
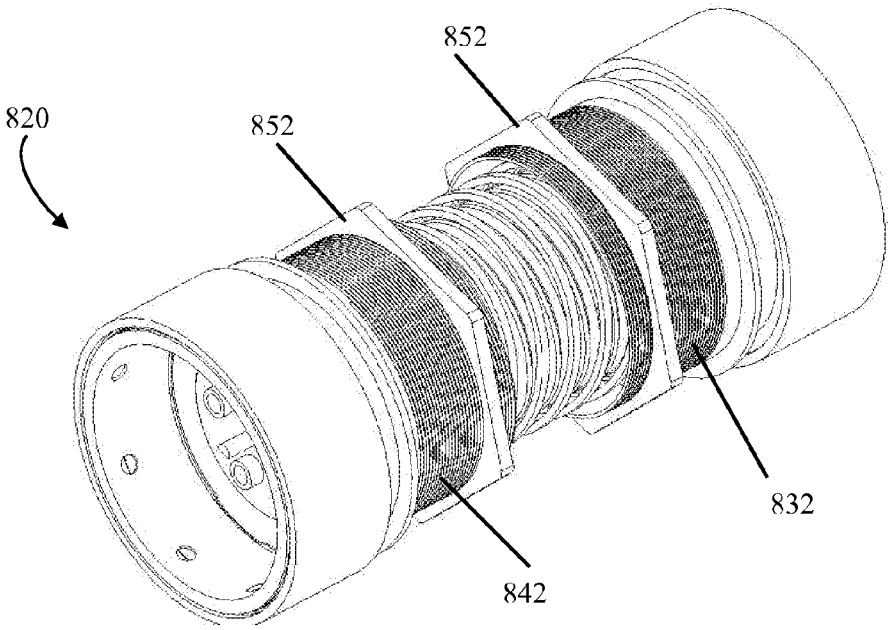
FIG. 21D is a view of the adapter of FIG. 21C without the turning ring shown in order to depict the internal components.

FIG. 21D is the FIG. 21C assembly with the turning ring 850 removed in order depict the interior of the assembly 820. The plug side housing 830 has a right hand thread 832 and housing 840 has a left hand thread 842. The inner diameter of the turning ring 850 is threaded correspondingly to match the thread 832 on housing 830 and thread 842 on housing 840. By turning the ring 850, housings 830 and 840 can move together or separate from each other in a manner similar to a common turnbuckle. The jam nuts 852 can be tightened against the turn ring 850, to keep both the housings 830 and 840 at a fixed distance and to prevent movement due to vibrations.

Figure 21E:
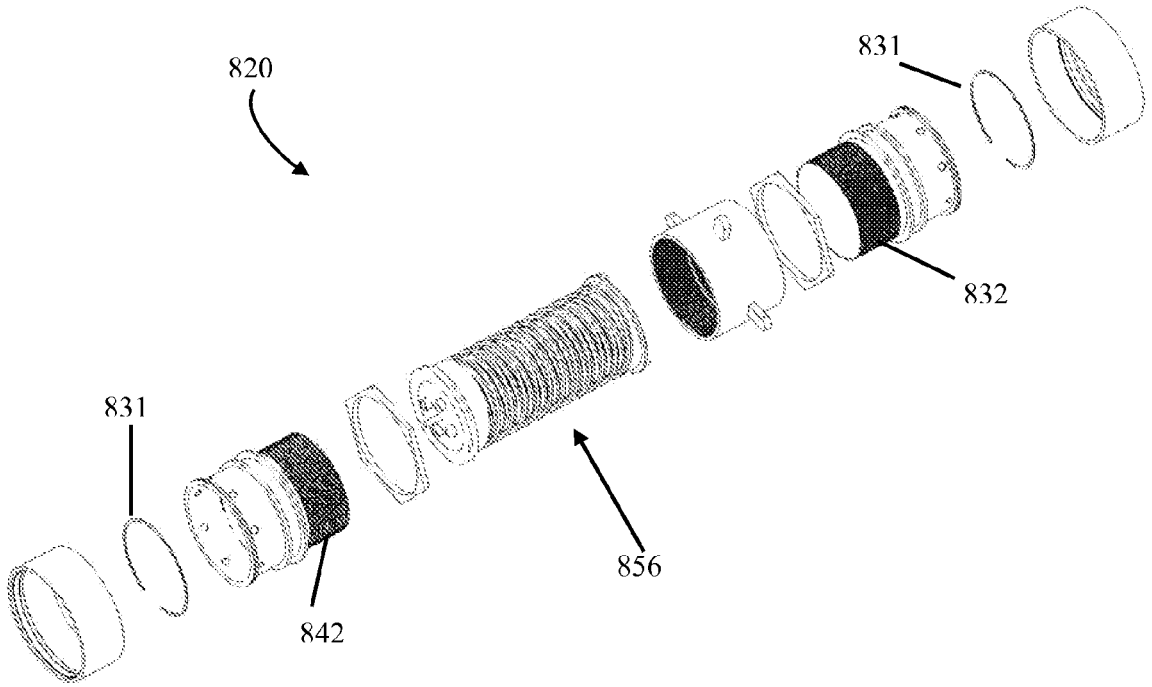
FIG. 21E is the exploded view of FIG. 21C.

FIG. 21E depicts an exploded view of adapter 820 that shows the interior bellows assembly 856. To keep the bellows assembly 856 in the housing 820 a snap ring 831 is installed on interior of each of the housing 830 and 840. Snap ring 831 is installed in a groove on the interior of both housing 830 and a groove on the interior of housing 840.

Figure 22A:
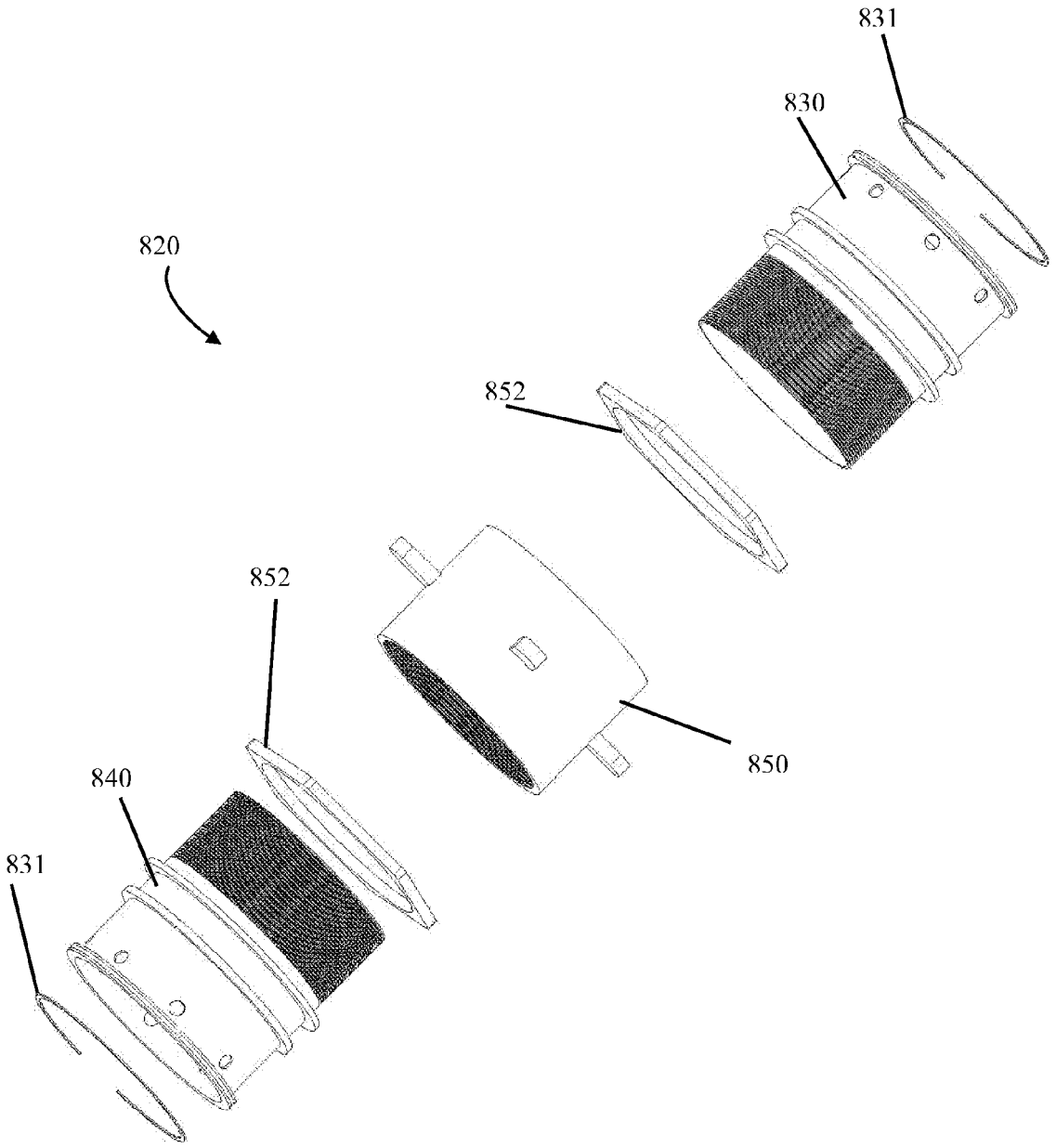
FIG. 22A depicts an exploded view of the adapter housing only.
Figure 22B:
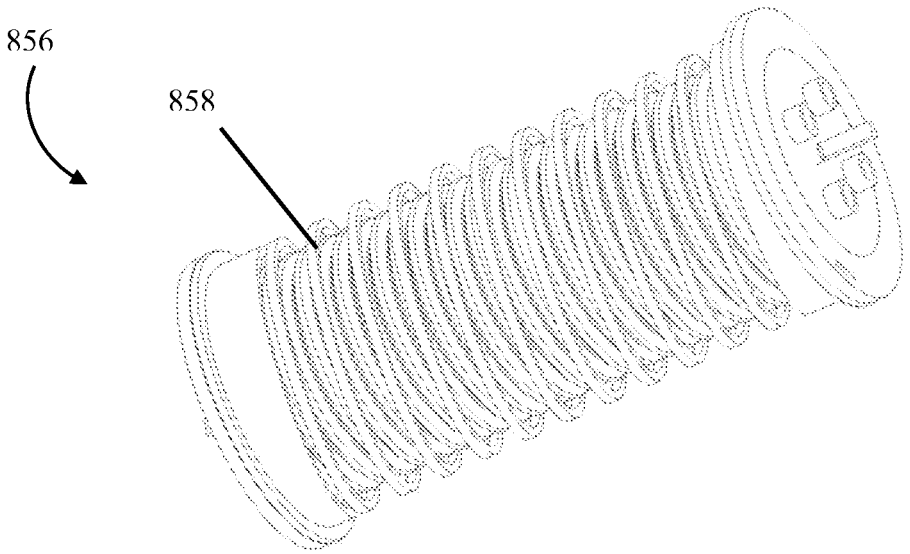
FIG. 22B is a perspective view of unmated bellows assembly.
Figure 22C:
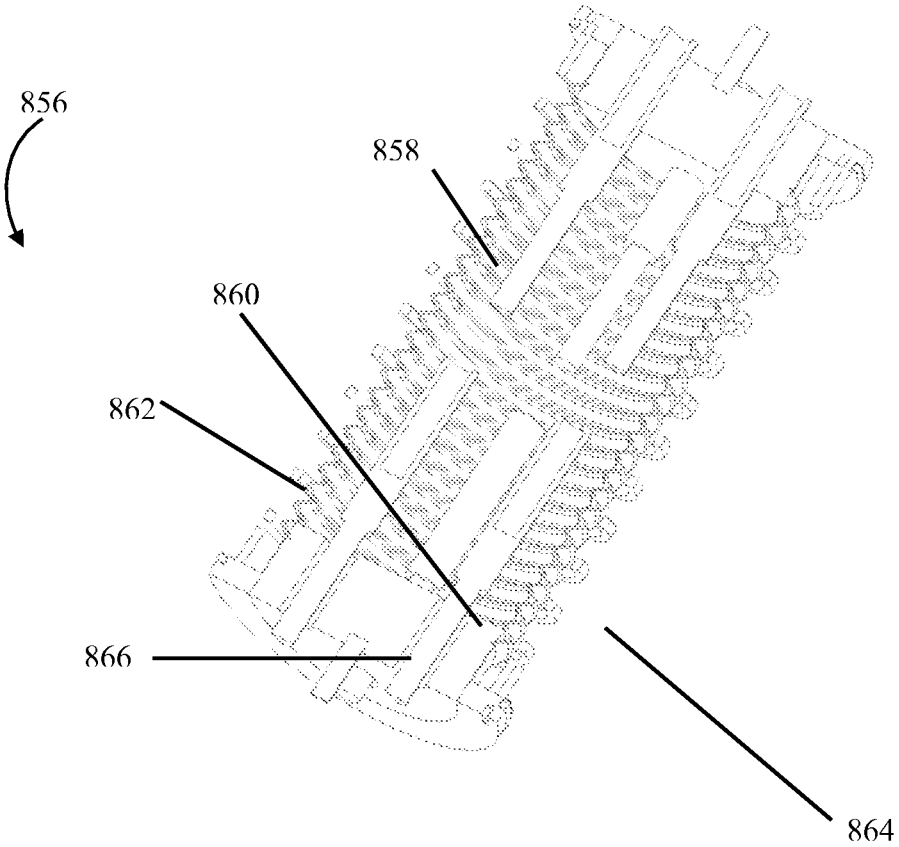
FIG. 22C depicts a cutaway view of the bellows inside adapter.

The exploded housing 820 detail with snap rings 831 is shown on FIG. 22A with the bellows assembly 856 and latching assembly removed. FIG. 22B shows the bellows assembly 856 plug side end. FIG. 22C shows the cut away view of the bellows assembly 856 with interior male contacts 864 and female contacts 866 that are not mated. The interior space 860 of the bellows assembly 856 can be filled with inert fluid similar to FC-72 as discussed above.

FIG. 23A is the external view of the mated adapter 820 with the plug 800 and socket 810 attached. FIG. 23B is the cut view of FIG. 23A. As shown in the cut view of FIG. 23B, the plug contacts 420 are mated with the bellows contact 864 on plug end and the socket contacts 818 are mated with bellows contacts 866 on the opposite end. The contacts 864, 866 inside the bellows are not mated as the housing 830 and 840 are apart from each other at the far ends of the center of the turn ring 850. Turning ring 850 brings the two housings 830 and 840 together and mates the interior bellows contacts 864, 866 together.

Figure 24A:
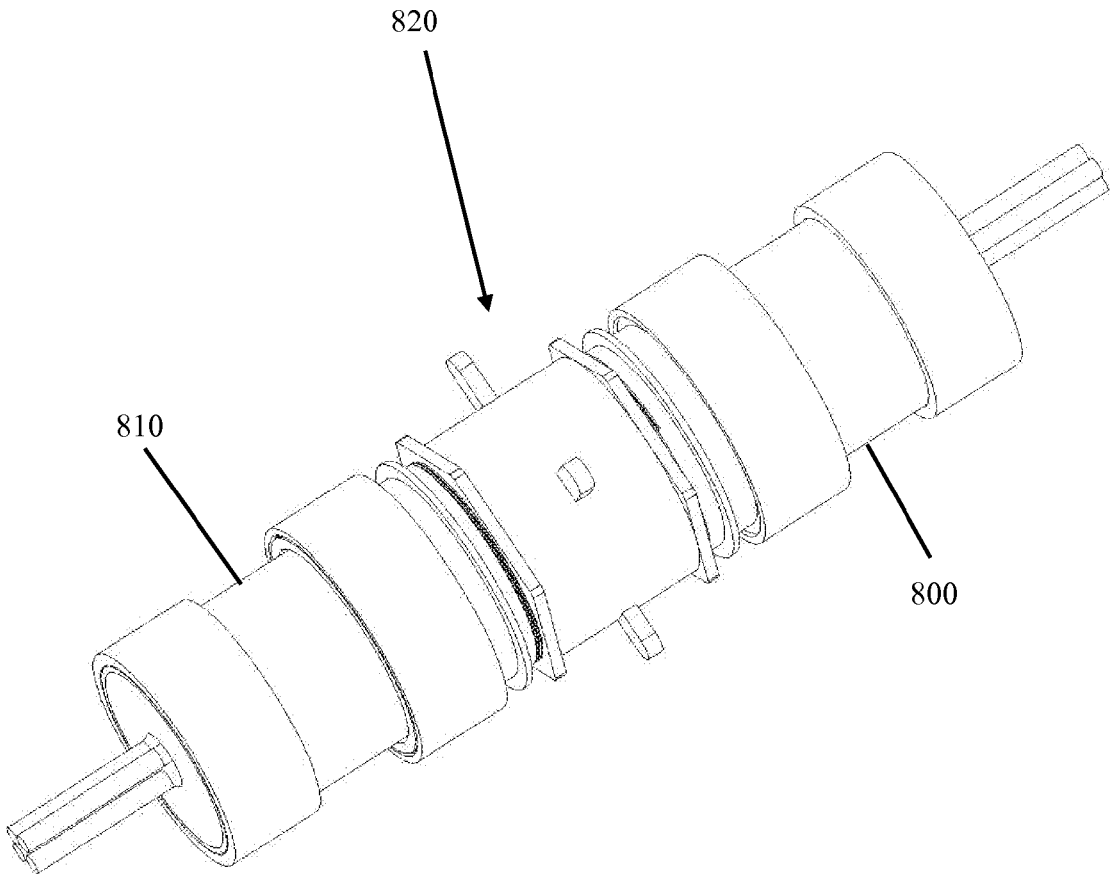
FIG. 24A depicts the mated adapter assembled with plug and socket drawn together.
Figure 24B:
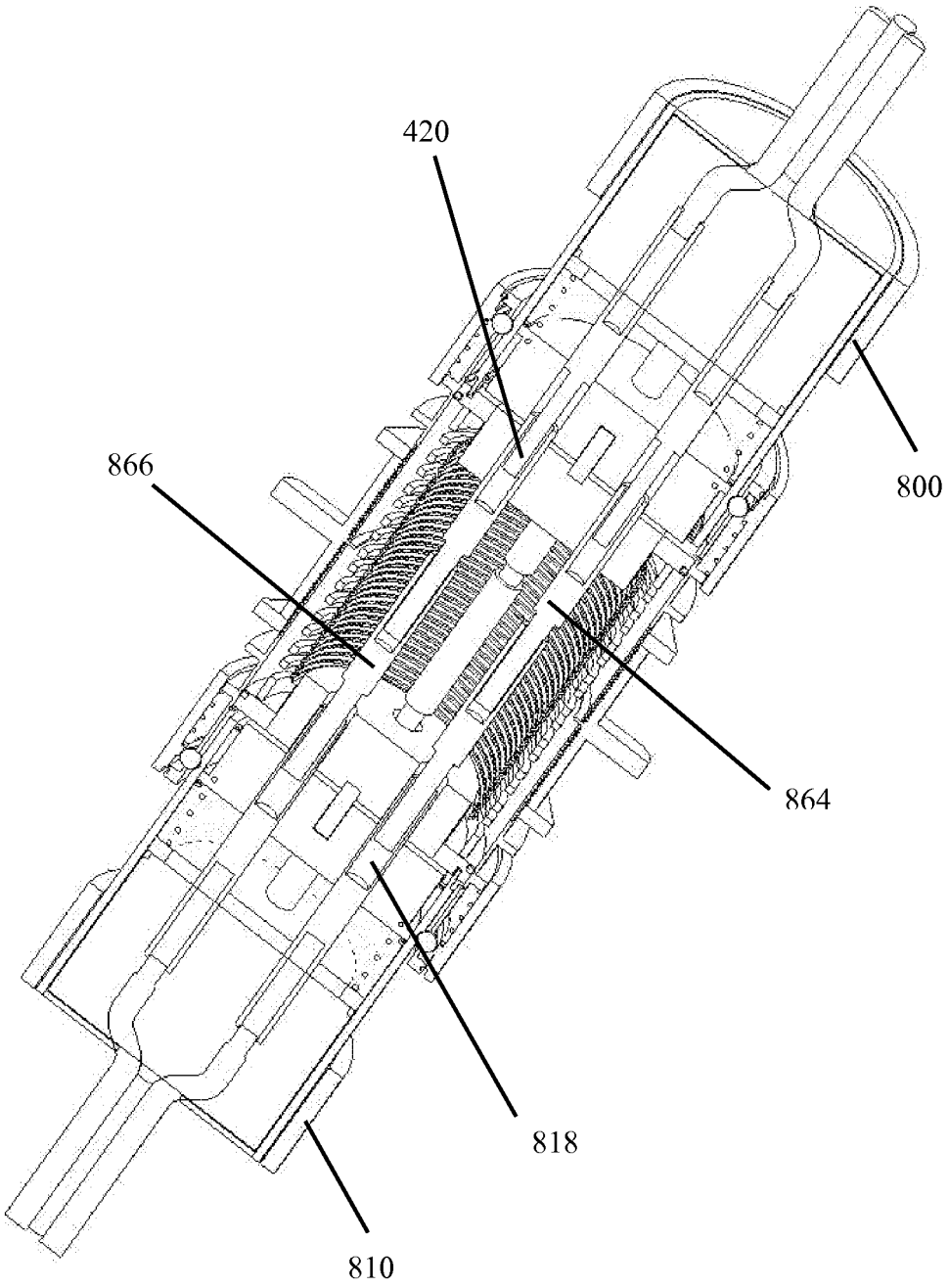
FIG. 24B is the cutaway view of mated adapter assembled with plug and socket of FIG. 24A.

FIG. 24A is the external view of the mated adapter 820 with the plug and socket attached. FIG. 24B is the cut view of FIG. 24A. It is visible from the cut view that the plug contacts 420 are mated with the bellows contact on plug end and the socket contacts are mated with bellows contacts on the opposite end. The contacts 864, 866 inside the bellows are now mated as the housing 830 and 840 are closer to each other at the turn ring 850. The mated contact length at the both ends of the adapter will be slightly less, but is never unmated. The rotation of turning ring 850 will move the housings apart to bring the adapter 820 to an unmated condition.

Figure 24C:
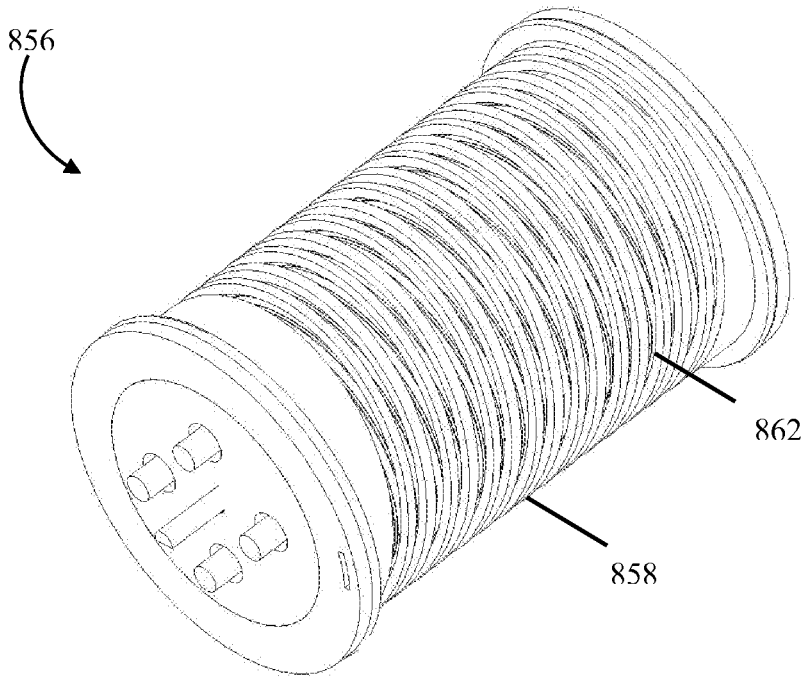
FIG. 24C is a view of bellows assembly inside the assembly of FIG. 24A.

FIG. 24C is the view of the bellows assembly 856 inside a mated adapter 820 which is slightly shorter in length due to compression. The spring 858 and the bellows 862 are compressed together to mate the interior bellows contact.

Figure 24D:
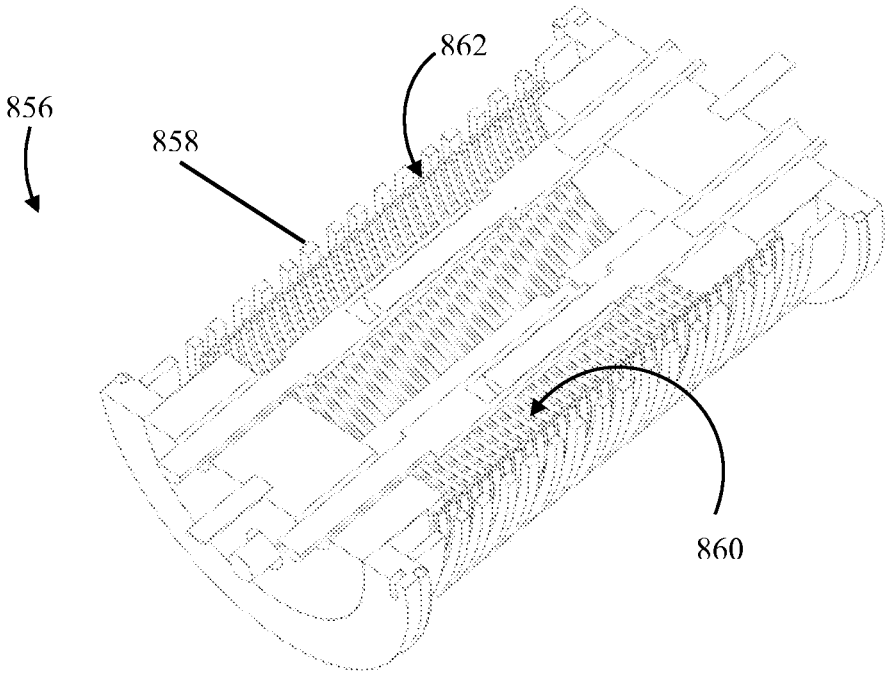
FIG. 24D is the cutaway view of FIG. 24C.

FIG. 24D is the cut view of FIG. 24C showing the mating of the interior bellows contacts. The bellows contacts are submerged in the fluid that fills the space 860 inside bellows While the interior bellows contacts are mated, the end contacts at the plug and socket end are never unmated by turning the ring 850.

Figure 25A:
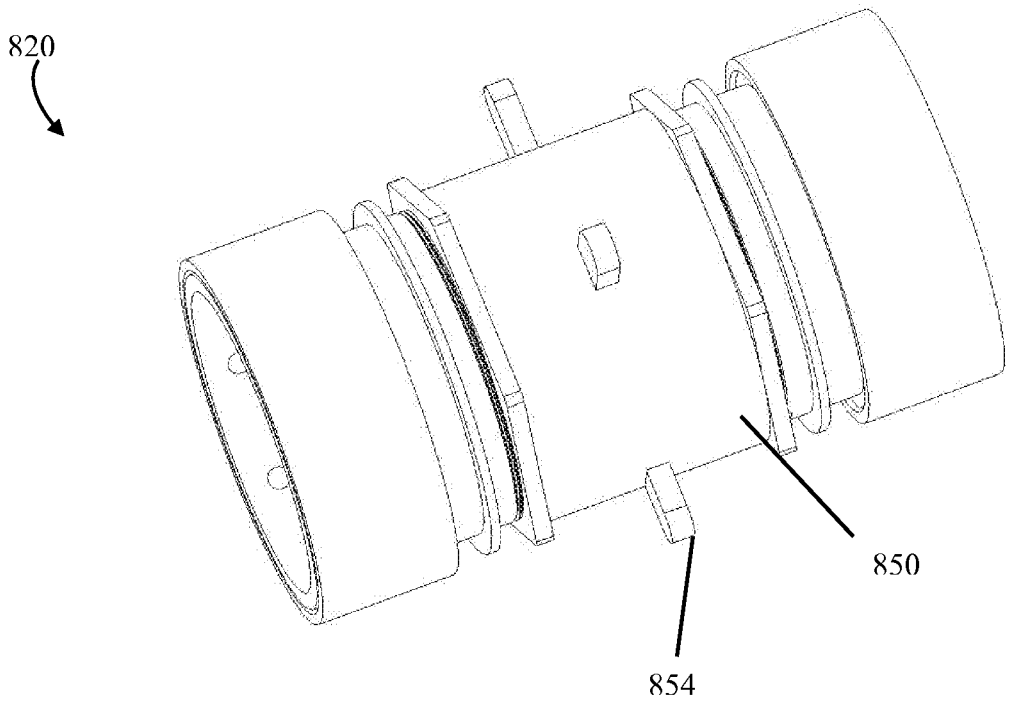
FIG. 25A is the view of the adapter housing assembly only when bellows are mated.
Figure 25B:
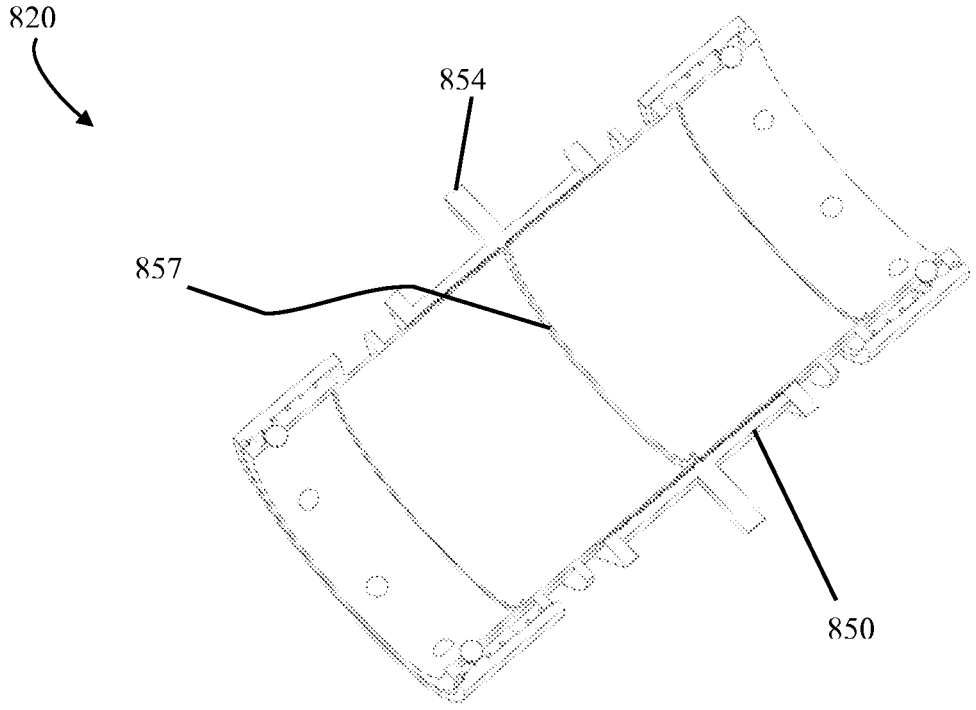
FIG. 25B is the cut view of the adapter housing assembly when bellows are mated.
Figure 25C:
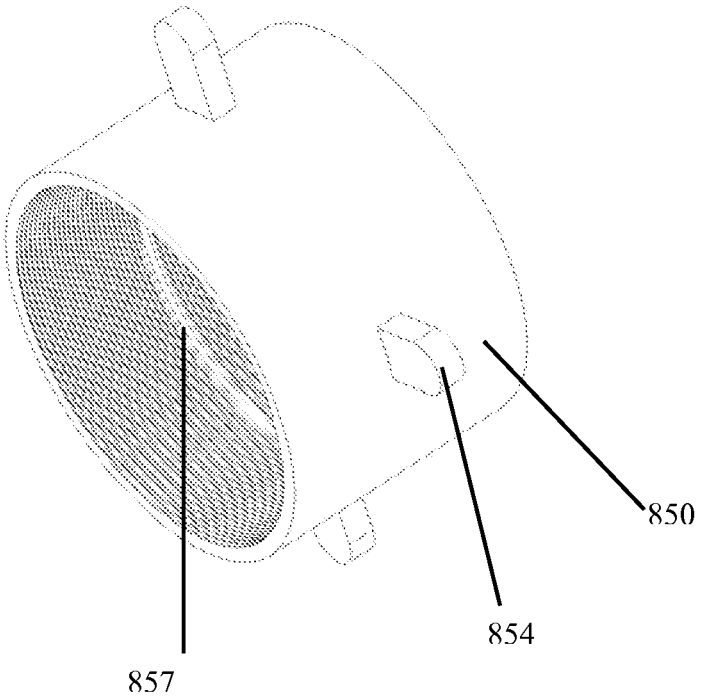
FIG. 25C is a perspective view of the turning ring.

The mated adapter housing is shown on FIG. 25A with the turn ring 850. The handles 854 extending from the turn ring 850 are used for turning the ring to mate and unmate the connector contact inside the bellows. The cut view of FIG. 25A is shown on FIG. 25B. The center ring portion 857 is shown in between the housing is part of the turn ring. Housing 830 and 840 butt against the interior stop ring 857 of turn ring 850 at their closest position, when the contacts are mated. The interior stop ring 857 of turning ring 850 is located at the center of the connector assembly 820. FIG. 25C is a view of the adapter turning ring showing the threads on the interior.

The embodiments above are intended to be illustrative and not limiting. Additional embodiments are encompassed within the scope of the claims. Although the present invention has been described with reference to particular embodiments, those skilled in the art will recognize that changes may be made in form and detail without departing from the spirit and scope of the invention. For purposes of interpreting the claims for the present invention, it is expressly intended that the provisions of Section 112, sixth paragraph of 35 U.S.C. are not to be invoked unless the specific terms "means for" or "step for" are recited in a claim.

What is claimed:

1. An electrical connector system comprising:

a plug assembly and a socket assembly;

wherein the plug assembly includes:

at least one contact post configured to receive a first conductor;

a housing enclosing the contact post and having an aperture to receive the first conductor within the housing;

a plug insulator located opposite the aperture, the plug insulator sized to extend beyond the housing in an unmated configuration and retract into the housing in a mated configuration, and having at least one opening where the contact post is seated; and a plug assembly spring disposed between an interior surface of the housing and the plug insulator, wherein the plug insulator is biased to the unmated configuration by the plug assembly spring; and wherein the socket assembly includes:

at least one coupler having a contact receptacle sized to mate with the contact post and having an internal-contact post opposite the coupler;

a socket insulator having at least one via sized to house the contact receptacle;

a bellows assembly attached to the socket insulator having an internal-coupler configured to mate with the internal-contact post when the bellows is compressed, the internal-coupler extending through the bellows assembly and configured to receive a second conductor;

an inert fluid contained in the bellows assembly such that the internal-contact post and the internal-coupler are both submerged in the inert fluid;

a socket assembly spring surrounding the bellows assembly and biased to expand the bellows assembly; and an exterior socket housing that contains the socket assembly spring, the bellows assembly, the socket insulator, the at least one coupler, and having a latch mechanism to secure the housing of the plug assembly to the socket assembly;

wherein when the plug assembly and the socket assembly are configured such that the plug insulator and the socket insulator abut prior to contact between the at least one contact post and the contact receptacle, and such that an electrical connection between the first conductor and the second conductor is formed when the internal-contact post and the contact receptacle mate while submerged in the inert fluid.

2. The electrical connector system of claim 1, wherein the plug assembly further comprises: an insulating layer disposed between the plug assembly spring and an interior cavity formed within the exterior housing.

3. The electrical connector system of claim 1, wherein the socket assembly further comprises: an insulating layer disposed between the spring assembly and the bellows assembly.

4. The electrical connector system of claim 1, wherein the socket assembly further comprises:

a latching mechanism configured to releasably retain the plug housing within the socket housing.

* * * * *